US008973503B2

(12) United States Patent
Dunaway et al.

(10) Patent No.: US 8,973,503 B2
(45) Date of Patent: Mar. 10, 2015

(54) FRAGMENTATION BODIES, WARHEADS INCLUDING FRAGMENTATION BODIES, AND RELATED ORDNANCE

(75) Inventors: James D. Dunaway, Brigham City, UT (US); John E. Bott, Brigham City, UT (US)

(73) Assignee: Alliant Techsystem Inc., Arlington, VA (US)

( * ) Notice: Subject to any disclaimer, the term of this patent is extended or adjusted under 35 U.S.C. 154(b) by 196 days.

(21) Appl. No.: 13/550,705

(22) Filed: Jul. 17, 2012

(65) Prior Publication Data

US 2014/0182474 A1 Jul. 3, 2014

(51) Int. Cl.

| | |
|---|---|
| ***F42B 15/10*** | (2006.01) |
| ***F42B 12/24*** | (2006.01) |
| ***F42B 15/00*** | (2006.01) |

(52) U.S. Cl.

CPC ..... *F42B 12/24* (2013.01); *F42B 15/00* (2013.01)

USPC ..... 102/495; 102/374

(58) Field of Classification Search

CPC ..... F42B 12/22; F42B 12/24

USPC ..... 102/492, 493–495, 506, 374

See application file for complete search history.

(56) References Cited

U.S. PATENT DOCUMENTS

| | | | | |
|---|---|---|---|---|
| 2,023,158 | A * | 12/1935 | Williams | 102/482 |
| 3,757,693 | A * | 9/1973 | Shea | 102/493 |
| 4,824,624 | A * | 4/1989 | Palicka et al. | 264/632 |
| 5,157,225 | A | 10/1992 | Adams et al. | |
| 6,962,634 | B2 | 11/2005 | Nielson et al. | |
| 7,614,348 | B2 | 11/2009 | Truitt et al. | |
| 8,061,275 | B1 | 11/2011 | Gold | |
| 2008/0102303 | A1 | 5/2008 | Brent et al. | |

OTHER PUBLICATIONS

International Search Report and Written Opinion for PCT Application No. PCT/US2013/050653, mailed Feb. 18, 2014.

* cited by examiner

*Primary Examiner* — Reginald Tillman, Jr.
(74) *Attorney, Agent, or Firm* — TraskBritt

(57) ABSTRACT

A fragmentation body comprising a substantially monolithic structure comprising a metal material and comprising a major surface having an indentation pattern therein, and an opposing major surface having an opposing indentation pattern therein, the opposing indentation pattern being substantially aligned with the indentation pattern. A warhead and an article of ordnance are also described.

30 Claims, 24 Drawing Sheets

Switchblade Sintered Fragment Plate - C1A2 - Overview - Taper Cut - 5X

FRAGMENTATION BODIES, WARHEADS INCLUDING FRAGMENTATION BODIES, AND RELATED ORDNANCE

FIELD

The present disclosure, in various embodiments, relates generally to fragmentation bodies, warheads including the fragmentation bodies, and related ordnance.

BACKGROUND

Numerous conventional warheads, such as a conventional SWITCHBLADE™ warhead, include a containment (i.e., a warhead case), an explosive charge within the containment, a backer plate on the explosive charge, and discrete preformed fragments embedded in an adhesive material on the backer plate. Upon a detonation, which may also be characterized as an explosive "launch" of the explosive charge, the discrete preformed fragments are propelled from the warhead such that least a portion of the discrete preformed fragments may act upon an intended target. Warhead efficacy is thus at least partially a factor of the quantity, size, shape, density, distribution, and velocity of the discrete preformed fragments.

Disadvantageously, such conventional warhead configurations can provide limited efficiency. For example, venting of explosive detonation-generated gases between the discrete preformed fragments, and substantially inevitable irregularities in the spacing and distribution of the discrete preformed fragments can impede the performance (e.g., velocity, trajectory, etc.) of the discrete preformed fragments upon explosive launch. In addition, adhesive material extruded through spaces between each of the discrete preformed fragments is difficult to remove and can interfere with the proper seating and effectiveness of the discrete preformed fragments in terms of velocity and direction of their respective trajectories. Furthermore, it is time consuming and cost-inefficient to arrange and place the discrete preformed fragments in the adhesive material.

Accordingly, it would be desirable to have a structure facilitating improved fragment performance upon explosive launch. It would be further desirable to be able to selectively generate variations in fragment quantity, configuration (e.g., size and shape), and distribution (e.g., scatter patterns) upon explosive launch. In addition, it would be desirable if the structure was easy to form, was easy to handle, and was cost-efficient.

SUMMARY

Embodiments described herein include fragmentation bodies, warheads including the fragmentation bodies, and related weapons.

For example, in accordance with one embodiment described herein, a fragmentation body comprises a substantially monolithic structure comprising a metal material and comprising a major surface having an indentation pattern therein, and an opposing major surface having an opposing indentation pattern therein, the opposing indentation pattern substantially aligned with the indentation pattern.

In additional embodiments, a warhead comprises an explosive charge and at least one fragmentation body adjacent the explosive charge. The fragmentation body comprises a substantially monolithic structure comprising a metal material and comprising a major surface having an indentation pattern therein, and an opposing major surface having an opposing indentation pattern therein, the opposing indentation pattern substantially aligned with the indentation pattern.

In yet additional embodiments, an article of ordnance comprises a rocket motor and a warhead. The warhead comprises an explosive charge and at least one fragmentation body adjacent the explosive charge. The fragmentation body comprises a substantially monolithic structure comprising a metal material and comprising a major surface having an indentation pattern therein, and an opposing major surface having an opposing indentation pattern therein, the opposing indentation pattern substantially aligned with the indentation pattern.

DETAILED DESCRIPTION

Figure 1A:
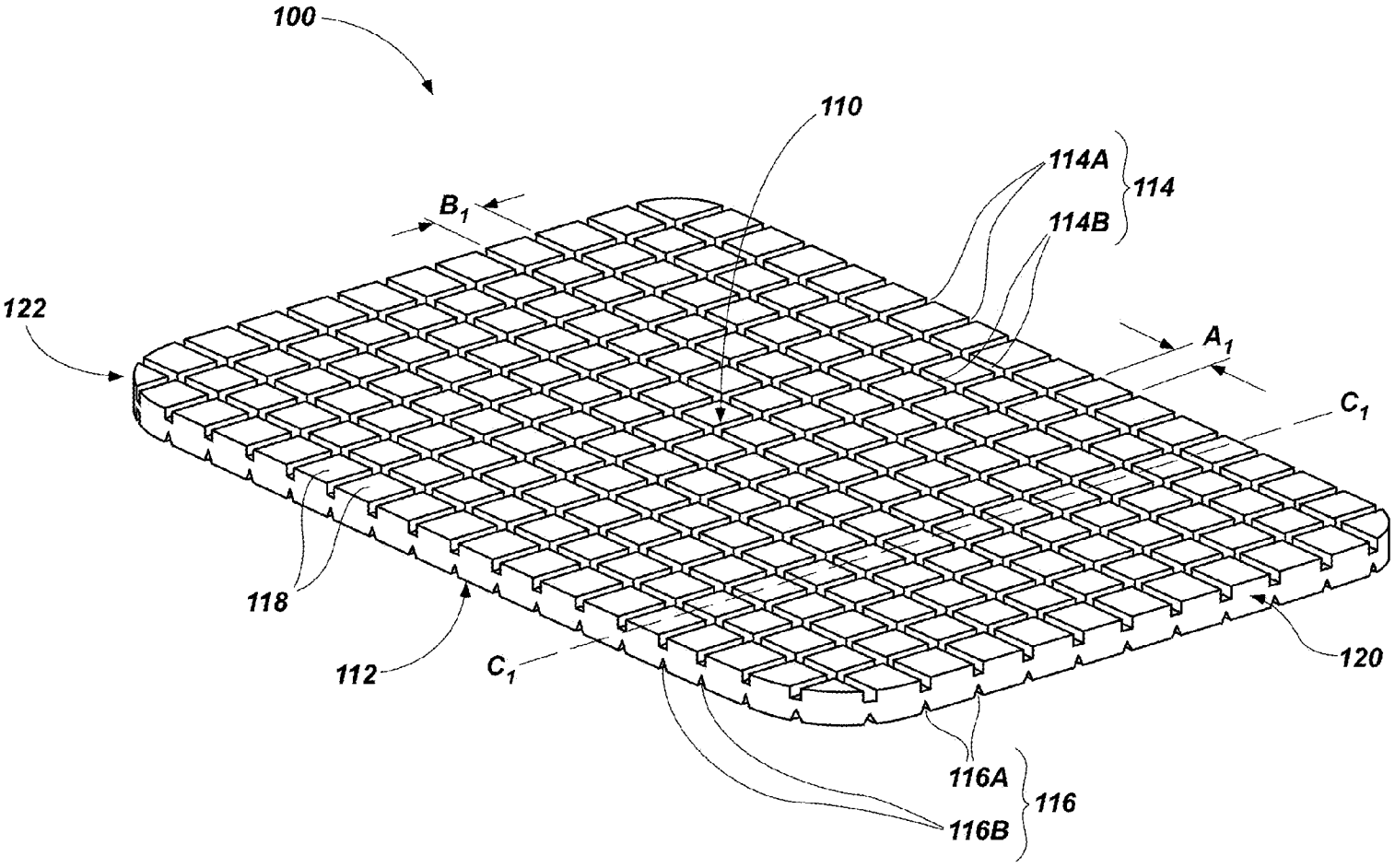
FIG. 1A is a perspective view of a fragmentation body in accordance with an embodiment of the present disclosure.

Fragmentation bodies are disclosed, as are warheads including the fragmentation bodies, and related ordnance. As used herein, the term "fragmentation body" means and includes a structure configured to substantially break up into fragments having at least one of a desired shape and a desired size upon the occurrence of a triggering event, such as a detonation or explosive launch of an explosive charge of a warhead incorporating the fragmentation body. The fragmentation bodies of the present disclosure may be used to increase warhead performance (e.g., fragment velocities and fragment trajectories) of and to reduce the manufacturing cost of a warhead.

The following description provides specific details, such as material types, material thicknesses, and processing conditions in order to provide a thorough description of embodiments of the present disclosure. However, a person of ordinary skill in the art would understand that the embodiments of the present disclosure may be practiced without employing these specific details. Indeed, the embodiments of the present disclosure may be practiced in conjunction with conventional techniques employed in the industry. Only those process acts and structures necessary to understand the embodiments of the present disclosure are described in detail below. Additional acts to form at least one of the fragmentation bodies of the present disclosure, the warheads of the present disclosure, and the weapons of the present disclosure may be performed by conventional techniques, which are not described in detail herein. Also, the drawings accompanying the present application are for illustrative purposes only, and are thus not drawn to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, relational terms, such as "first," "second," "over," "top," "bottom," "underlying," etc., are used for clarity and convenience in understanding the disclosure and accompanying drawings and does not connote or depend on any specific preference, orientation, or order, except where the context clearly indicates otherwise.

As used herein, the term "monolithic" as applied to fragmentation bodies of embodiments of the disclosure means and includes bodies formed as, and comprising a single, unitary structure of a metal material.

FIG. 1A illustrates a perspective view of a fragmentation body 100 in accordance with an embodiment of the present disclosure. The fragmentation body 100 may be a substantially monolithic structure including a major surface 110, an opposing major surface 112, and at least one major peripheral sidewall 120. As shown in FIG. 1A, the at least one major peripheral sidewall 120 may run substantially perpendicular to each of the major surface 110 and the opposing major surface 112. In additional embodiments, at least one of the at least one major peripheral sidewall 120 may run substantially non-perpendicular (i.e., at an angle other than about 90 degrees) to each of the major surface 110 and the opposite major surface 112. The major surface 110 may include an indentation pattern 114. The opposing major surface 112 may include an opposing indentation pattern 116 substantially aligned with the indentation pattern 114. Such an arrangement may also be characterized as the two indentation patterns 114 and 116 comprising mirror image patterns. In at least some embodiments, the opposing indentation pattern 116 may be provided more proximate an explosive charge of a warhead than the indentation pattern 114, as described in further detail below. The indentation pattern 114 and the opposing indentation pattern 116 may cooperatively at least partially define interconnected fragments 118, as described in further detail below. In additional embodiments, one of the indentation pattern 114 and the opposite indentation pattern 116 may be omitted.

As shown in FIG. 1A, the fragmentation body 100 may be substantially planar, and may have a generally rectangular peripheral shape. In further embodiments, the fragmentation body 100 may be substantially curved, and further embodiments may include at least one substantially curved portion and at least one substantially planar portion. In yet further embodiments, the fragmentation body 100 may have other peripheral shapes including, but not limited to, circular, semicircular, crescent, ovular, annular, astroidal, deltoidal, ellipsoidal, triangular, tetragonal (e.g., square, rectangular, trapezium, trapezoidal, parallelogram, kite, rhomboidal, etc.), pentagonal, hexagonal, heptagonal, octagonal, enneagonal, decagonal, truncated versions thereof, or an irregular peripheral shape. As depicted in FIG. 1A, the fragmentation body 100 may include at least one corner 122 having a substantially rounded configuration. In additional embodiments, if the fragmentation body 100 includes the at least one corner 122, the at least one corner 122 may have a different configuration, such as a substantially sharp configuration, or a combination of a rounded configuration and a sharp configuration. The fragmentation body 100 may have any desired dimensions, depending on at least one of a desired size and a desired quantity of the interconnected fragments 118, as described in further detail below.

Each of the indentation pattern 114 and the opposing indentation pattern 116 may include a plurality of indentations, such as one or more arrays of indentations. For example, with continued reference to FIG. 1A, the indentation pattern 114 may include a first array of indentations 114A extending in a first direction across the major surface 110, and a second array of indentations 114B extending in a second direction across the major surface 110. The first array of indentations 114A may at least partially intersect the second array of indentations 114B. Similarly, the opposing indentation pattern 116 may include a first opposing array of indentations 116A extending across the opposing major surface 112 in the first direction and a second opposing array of indentations 116B extending across the opposing major surface 112 in the second direction. The first opposing array of indentations 116A may at least partially intersect with the second opposing array of indentations 116B. The first array of indentations 114A may be substantially aligned with the first opposing array of indentations 116A, and the second array of indentations 114B may be substantially aligned with the second opposing array of indentations 116B. As depicted in FIG. 1A, each of the first array of indentations 114A and the first opposing array of indentations 116A may run substantially perpendicular (i.e., at a 90 degree angle) to each of the second array of indentations 114B and the first opposing array of indentations 116A. In additional embodiments, each of the first array of indentations 114A and the first opposing array of indentations 116A may run substantially non-perpendicular to each of the second array of indentations 114B and the second opposing array of indentations 116B.

In one or more embodiments, each of the indentation pattern 114 and the opposing indentation pattern 116 may include at least one other indentation, such as at least one other array of indentations. As a non-limiting example, the indentation pattern 114 may include at least one additional array of indentations (not shown) extending across the major surface 110 in the first direction, the second direction, or in another direction. The at least one additional array of indentations may intersect with at least a portion of at least one of the first array of indentations 114A and the second array of indentations 114B. Similarly, the opposing indentation pattern 116 may include at least one additional opposing array of indentations (not shown) extending across the opposing major surface 112 in the first direction, the second direction, or in the another direction. The at least one additional array of indentations may intersect with at least a portion of at least one of the first opposing array of indentations 116A and the second opposing array of indentations 116B. The at least one additional array of indentations may be substantially aligned with the at least one additional opposing array of indentations.

As illustrated in FIG. 1A, the first array of indentations 114A and the second array of indentations 114B may extend in substantially linear paths across the major surface 110, and the first opposing array of indentations 116A and the second opposing array of indentations 116B may extend in substantially linear paths across the opposing major surface 112. In additional embodiments, at least one of the first array of indentations 114A and the second array of indentations 114B may extend in substantially non-linear paths (e.g., v-shaped paths, u-shaped paths, angled paths, jagged paths, sinusoidal paths, curved paths, irregularly shaped paths, or a combination thereof) across at least a portion of the major surface 110, and at least one of the first opposing array of indentations 116A and the second opposing array of indentations 116B may extend in non-linear paths across at least a portion of the opposing major surface 112. In yet additional embodiments, if the indentation pattern 114 and the opposing indentation pattern 116 each include at least one other indentation, the at least one other indentation may extend in a linear path or may extend in a non-linear path.

As further illustrated in FIG. 1A, each of the first array of indentations 114A and the second array of indentations 114B may be substantially continuous across the major surface 110, and each of the first opposing array of indentations 116A and the second opposing array of indentations 116B may be substantially continuous across the opposing major surface 112. In further embodiments, at least a portion of at least one of the first array of indentations 114A and the second array of indentations 114B may be substantially discontinuous across the major surface 110, and at least a portion of at least one of the first opposing array of indentations 116A and the second opposing array of indentations 116B may be substantially discontinuous across the opposing major surface 112. By way of non-limiting example, at least a portion of each of the first array of indentations 114A and the second array of indentations 114B may terminate at one or more locations other than at the at least one major peripheral sidewall 120 of the fragmentation body 100, and at least a portion of each of the first opposing array of indentations 116A and the second opposing array of indentations 116B may terminate at one or more locations other than at the at least one major peripheral sidewall 120 of the fragmentation body 100. In yet additional embodiments, if the indentation pattern 114 and the opposing indentation pattern 116 each include at least one other indentation, the at least one other indentation may be substantially continuous or may be substantially discontinuous.

As illustrated in FIG. 1A, the indentation pattern 114 may be configured such that each indentation of the first array of indentations 114A is set apart from an adjacent parallel indentation of the first array of indentations 114A by a distance $A_1$ (i.e., the first array of indentations 114A may be uniformly spaced), and such that each indentation of the second array of indentations 114B is set apart from an adjacent parallel indentation of the second array of indentations 114B by a distance $B_1$ (i.e., the second array of indentations 114B may be uniformly spaced). Similarly, the opposing indentation pattern 116 may be configured such that each indentation of the first opposing array of indentations 116A is set apart from an adjacent parallel indentation of the first opposing array of indentations 116A by the distance $A_1$, and such that each indentation of the second opposing array of indentations 116B is set apart from an adjacent parallel indentation of the second opposing array of indentations 116B by the distance $B_1$. A magnitude of each of the distance $A_1$ and the distance $B_1$ may depend upon a desired fragmentation efficiency of the fragmentation body 100 and a desired mass of each of the interconnected fragments 118. A ratio between the distance $A_1$ and a height $H_1$ (FIG. 1B) of the fragmentation body 100 may be within a range of from about 1:1 to about 3:1, such as from about 1.5:1 to about 2.5:1, or from about 1.8:1 to about 2.2:1. Similarly, a ratio between the distance $B_1$ and the height $H_1$ (FIG. 1B) of the fragmentation body 100 may be within a range of from about 1:1 to about 3:1, such as from about 1.5:1 to about 2.5:1, or from about 1.8:1 to about 2.2:1. In at least some embodiments, a ratio between the distance $A_1$ and the height $H_1$ (FIG. 1B) is about 2:1, and a ratio between the distance $B_1$ and the height $H_1$ (FIG. 1B) is about 2:1. The distance $A_1$ and the distance $B_1$ may be substantially equal or may be substantially different. In at least some embodiments, the distance $A_1$ and the distance $B_1$ are substantially equal. In further embodiments, the indentation pattern 114 may be configured such that at least one of the first array of indentations 114A and the second array of indentations 114B is non-uniformly spaced. Similarly, the opposing indentation pattern 116 may be configured such that at least one of the first opposing array of indentations 116A and the second opposing array of indentations 116B is non-uniformly spaced. By way of non-limiting example, the first array of indentations 114A and the first opposing array of indentations 116A may each include at least one indentation set apart from an adjacent parallel indentation by a distance other than the distance $A_1$. As an additional non-limiting example, the second array of indentations 114B and the second opposing array of indentations 116B may each include at least one indentation set apart from an adjacent parallel indentation by a distance other than the distance $B_1$. In yet further embodiments, if the indentation pattern 114 and the opposing indentation pattern 116 each include at least one other array of indentations, the at least one other array of indentations may be uniformly spaced or may be non-uniformly spaced.

Each indentation of the indentation pattern 114 and each indentation of the opposing indentation pattern 116 may have a width, depth, and shape facilitating the break-up of the interconnected fragments 118 into substantially discrete fragments (not shown) of a substantially controlled shape and of a substantially controlled size upon the occurrence of a triggering event (e.g., an explosive launch). As a non-limiting example, each indentation of the indentation pattern 114 and each indentation of the opposing indentation pattern 116 may have a ratio of indentation width to indentation depth within a range of from about 1:1 to about 1:3, such as from about 1:1.5 to about 1:2.5, or from about 1:1.8 to about 1:2.2. In at least some embodiments, each indentation of the indentation pattern 114 and each indentation of the opposing indentation pattern 116 has a ratio of indentation width to indentation depth of about 1:2. In addition, each indentation of the indentation pattern 114 and each indentation of the opposing indentation pattern 116 may independently have any desired shape including, but not limited to, a triangular shape, a tetragonal shape, (e.g., square, rectangular, trapezium, trapezoidal, parallelogram, etc.), a semicircular shape, an ovular shape, and an elliptical shape. In the embodiment illustrated in FIG. 1A, each indentation of the indentation pattern 114 has a substantially rectangular shape, and each indentation of the opposing indentation pattern 116 has a substantially triangular shape. It will be appreciated that other indentation configurations (i.e., indentation widths, depths, and shapes) are also possible.

Figure 1B:
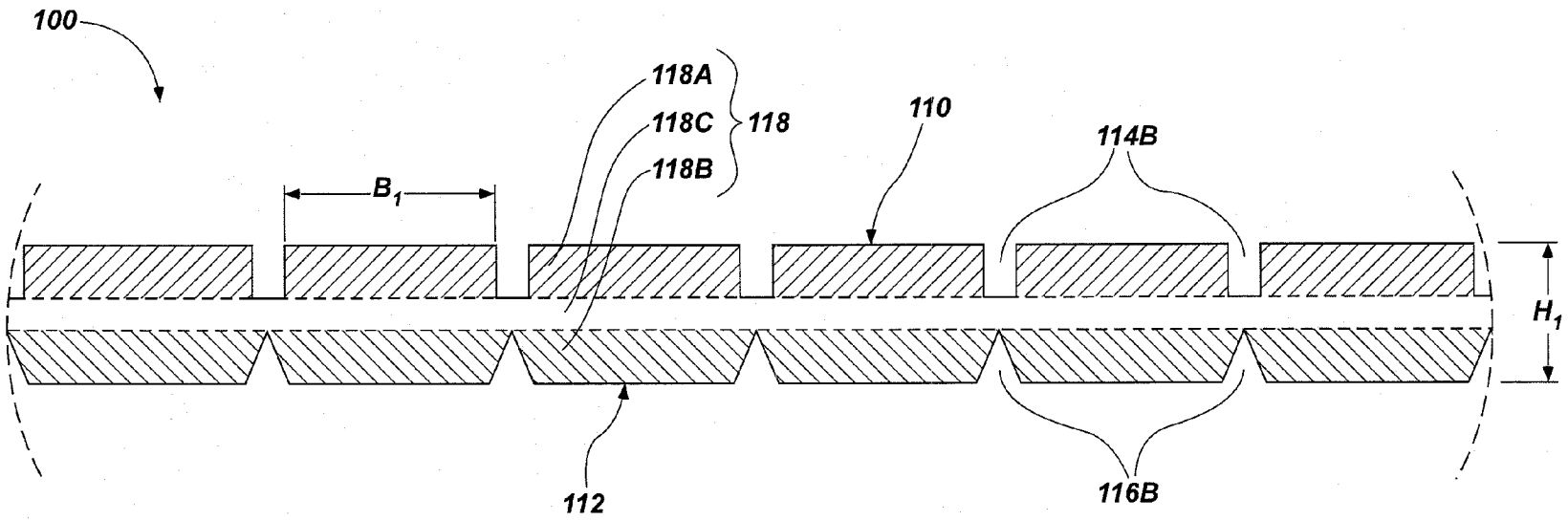
FIG. 1B is a cross-sectional view taken along a portion of line $C_1$-$C_1$ of FIG. 1A.

The indentation pattern 114 and the opposing indentation pattern 116 may at least partially cooperatively define the shape of each of the interconnected fragments 118. Referring to FIG. 1B, which illustrates a partial cross-sectional view of the fragmentation body 100 of FIG. 1A along line $C_1$-$C_1$, each of the interconnected fragments 118 may include a first region 118A, a second region 118B, and an intermediary region 118C. Each of the first region 118A and the second region 118B may extend outwardly from the intermediary region 118C, which may extend across the fragmentation body 100 and join together each of the interconnected fragments 118. The indentation pattern 114 may at least partially define the shape of the first region 118A of each of the interconnected fragments 118, and the opposing indentation pattern 116 may at least partially define the shape of the second region 118B of each of the interconnected fragments 118. For example, referring again to FIG. 1A, the substantially rectangular shape of each indentation of the indentation pattern 114 may define the first region 118A (FIG. 1B) of each of the interconnected fragments 118 as a substantially rectangular column. Furthermore, the substantially triangular shape of the opposing indentation pattern 116 may define the second region 118B (FIG. 1B) of each of the interconnected fragments 118 as a substantially frusto-pyramid. In additional embodiments, the first region 118A (FIG. 1B) of each of the interconnected fragments 118 and the second region 118B (FIG. 1B) of each of the interconnected fragments 118 may independently be of a different shape including, but not limited to, one of a parallel-piped column, a rectangular column, a cylindrical column, a dome, a pyramid, a frusto-pyramid, a cone, a frusto-cone, and an irregular shape. The indentation pattern 114 and the opposing indentation pattern 116 may be such that at least one of the interconnected fragments 118 is of a substantially different shape than at least one other of the interconnected fragments 118.

The indentation pattern 114 and the opposing indentation pattern 116 may at least partially define the size of each of the interconnected fragments 118. For example, with continued reference to FIG. 1A, each of first array of indentations 114A and the second array of indentations 114B may define the first region 118A (FIG. 1B) of each of the interconnected fragments 118 to have a minimum width substantially equal to the distance $A_1$ and a minimum length substantially equal to the distance $B_1$. Similarly, each of first opposing array of indentations 116A and the second opposing array of indentations 116B may define the second region 118B (FIG. 1B) of each of the interconnected fragments 118 to have a minimum width equal to the distance $A_1$ and a minimum length equal to the distance $B_1$. A portion of at least one of the first region 118A (FIG. 1B) and the second region 118B (FIG. 1B) may have at least one of a length greater than the distance $B_1$ and a width greater than the distance $A_1$. For example, as depicted in FIG. 1B, a portion of the second region 118B of the interconnected fragments 118 may have a width greater than the distance $B_1$ (e.g., proximate an apex of each triangular shaped indentation of the second opposing array of indentations 114B). Referring again to FIG. 1A, in additional embodiments, such as where at least one indentation of one of more of the first array of indentations 114A and the second array of indentations 114B is non-uniformly spaced and/or discontinuous, the first region 118A (FIG. 1B) of at least one of the interconnected fragments 118 may be of a different length and/or different width than the first region 118A (FIG. 1B) of at least one other of the interconnected fragments 118. In yet additional embodiments, such as where at least one indentation of one of more of the first opposing array of indentations 116A and the second opposing array of indentations 116B is non-uniformly spaced and/or discontinuous, the second region 118B (FIG. 1B) of at least one of the interconnected fragments 118 may be of a different length and/or different width than the second region 118B (FIG. 1B) of at least one other of the interconnected fragments 118.

Referring to FIG. 1B, the first region 118A of each of the interconnected fragments 118 may be of substantially equal height, and the second region 118B of the interconnected fragments 118 may be of substantially equal height. In further embodiments, the first region 118A of at least one of the interconnected fragments 118 may be of a different height than the first region 118A of at least one other of interconnected fragments 118. In yet further embodiments, the second region 118B of at least one of the interconnected fragments 118 may be of a different height than the second region 118B of at least one other of interconnected fragments 118.

The dimensions of each of the interconnected fragments 118 may depend upon a desired mass for each of the interconnected fragments 118. By way of non-limiting example, the dimensions of each of the interconnected fragments 118 may be such that each of the interconnected fragments 118 has a mass within a range of from about 1 grain to about 30 grains, such as from about 2 grains to about 15 grains, or from about 3 grains to about 8 grains. The dimensions of each of the interconnected fragments 118 may be such that each of the interconnected fragments 118 has substantially equal mass. In additional embodiments, the dimensions of at least one interconnected fragment of the interconnected fragments 118 may be such that the least one interconnected fragment is of a substantially different mass than at least one other interconnected fragment of the interconnected fragments 118. In at least some embodiments, each of the interconnected fragments 118 has a mass of about 8 grains. In at least some additional embodiments, each of the interconnected fragments 118 has a mass of about 3 grains.

The size of the fragmentation body 100, the shape of the fragmentation body 100, the properties of the indentation pattern 114, and the properties of the opposing indentation pattern 116 may be such that the interconnected fragments 118 are arranged in a substantially organized manner. For example, as shown in FIG. 1A, the interconnected fragments 118 may be arranged as a matrix of columns (not numbered) and rows (not numbered). Each of the columns may run substantially parallel to each other of the columns, and each of the rows may run substantially parallel to each other of the rows. Each of the columns may run substantially perpendicular to each of the rows. Each of the columns may be substantially similar (e.g., each of the columns may have substantially the same size and substantially the same shape), or at least one of the columns may be substantially different than at least one other of columns. Similarly, each of the rows may be substantially similar (e.g., each of the rows may have substantially the same size and substantially the same shape), or at least one of the rows may be substantially different than at least one other of the rows. For example, as shown in FIG. 1A, at least one row of the interconnected fragments 118 adjacent one of the at least one major peripheral sidewall 120 of the fragmentation body 100 may be substantially different than at least one row of the interconnected fragments 118 not adjacent one of the at least one major peripheral sidewall 120 of the fragmentation body 100. Similarly, at least one column of the interconnected fragments 118 adjacent one of the at least one major peripheral sidewall 120 of the fragmentation body 100 may be substantially different than at least one substantially parallel column of interconnected fragments 118 not adjacent one of the at least one major peripheral sidewall 120 of the fragmentation body 100. In additional embodiments, at least one of the size of the fragmentation body 100, the shape of the fragmentation body 100, the properties of the indentation pattern 114, and the properties of the opposing indentation pattern 116 may be such that at least a portion of the interconnected fragments 118 are arranged in a substantially disorganized manner.

Throughout the remaining description and the accompanying figures, functionally similar features are referred to with similar reference numerals incremented by 100. To avoid repetition, not all features shown in FIGS. 2A through 6B are described in detail herein. Rather, unless described otherwise below, features designated by a reference numeral that is a 100 increment of the reference numeral of a feature described previously will be understood to be substantially similar to the feature described previously.

Figure 2A:
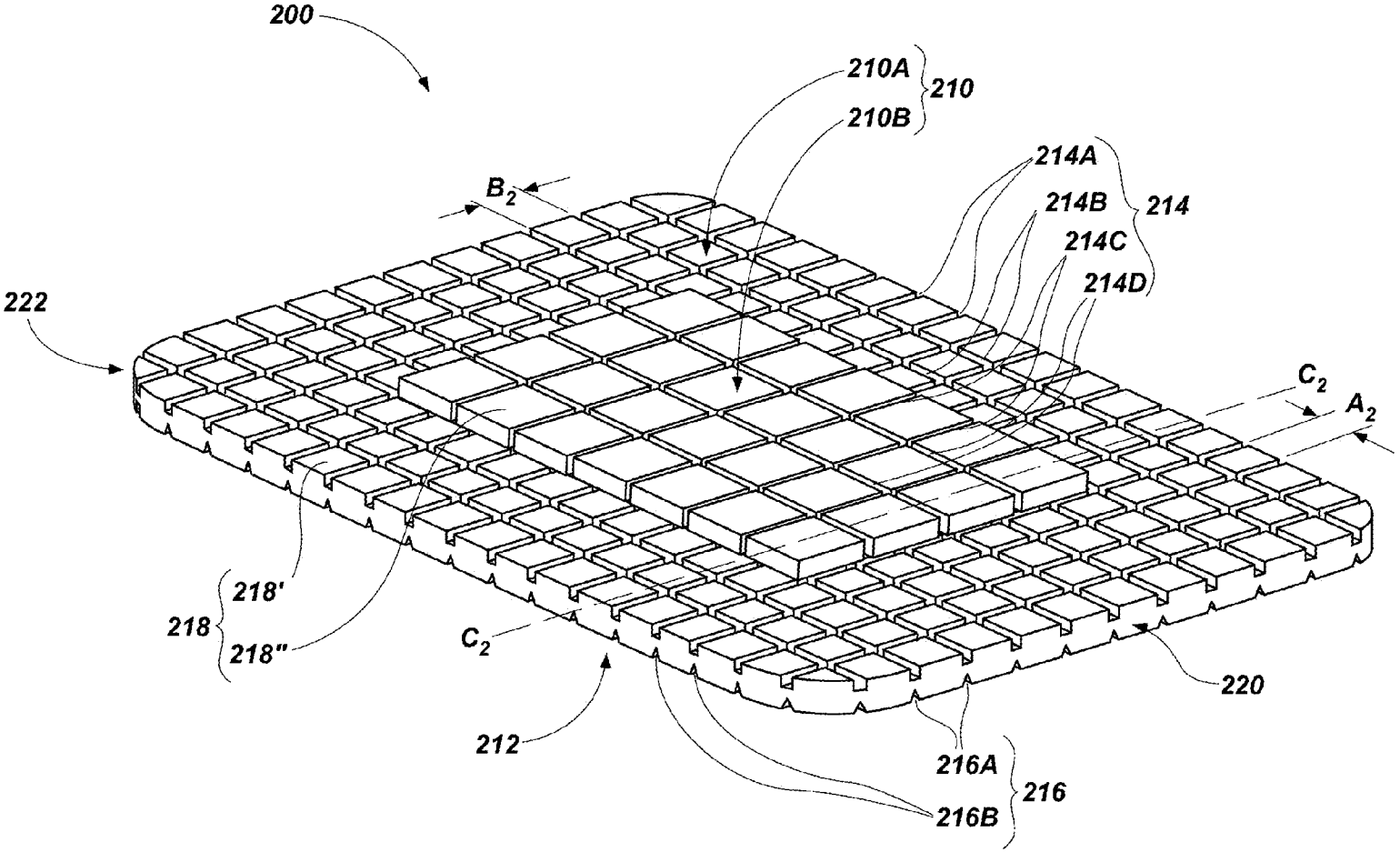
FIG. 2A is a perspective view of a fragmentation body in accordance with another embodiment of the present disclosure.

FIG. 2A illustrates a perspective view of a fragmentation body 200 in accordance with another embodiment of the present disclosure. The fragmentation body 200 includes a major surface 210, an opposing major surface 212, and at least one major peripheral sidewall 220. The major surface 210 may include at least one elevated portion 210B and a remaining portion 210A. In additional embodiments, the opposing major surface 212 may include at least one opposing elevated portion (not shown) and an opposing remaining portion (not shown). If present, the opposing elevated portion may be substantially similar to the at least one elevated portion 210B (e.g., in size and shape), or may be substantially different than the at least one elevated portion 210B. If present, the opposing elevated portion may be substantially aligned with the at least one elevated portion 210B, or may be substantially unaligned with the at least one elevated portion 210B. In yet additional embodiments, the at least one elevated portion 210B may be absent from the major surface 210 (e.g., the at least one elevated portion 210B shown in FIG. 2A may be coplanar with the remaining portion 210 shown in FIG. 2A) and the at least one the opposing major surface 212 may include the at one opposing elevated portion. As illustrated in FIG. 2A, the at least one elevated portion 210B may be located at a substantially central position along the major surface 210. In additional embodiments, the at least one elevated portion 210B may be located at one or more substantially non-central positions along the major surface 210.

As shown in FIG. 2A, the major surface 210 may include an indentation pattern 214, and the opposing major surface 212 may include an opposing indentation pattern 216 substantially aligned with the indentation pattern 214. By way of non-limiting example, the indentation pattern 214 may include a first array of indentations 214A, a second array of indentations 214B, a third array of indentations 214C, and a fourth array of indentations 214D. Each of the third array of indentations 214C and the fourth array of indentations 214D may extend across the at least one elevated portion 210B of the major surface 210. Each of the first array of indentations 214A and the second array of indentations 214B may extend across the remaining portion 210A of the major surface 210. Similarly, the opposing indentation pattern 216 may include a first opposing array of indentations 216A, a second opposing array of indentations 214B, a third opposing array of indentations (not shown), and a fourth opposing array of indentations (not shown). Each of the third opposing array of indentations and the fourth opposing array of indentations may extend across a portion of the opposing major surface 210 substantially aligned with the at least one elevated portion 210B of the major surface 210. Each of the first opposing array of indentations 216A and the second opposing array of indentations 216B may extend across another portion of the opposing major surface 210 substantially aligned with the remaining portion 210A of the major surface 210. In additional embodiments, each of the indentation pattern 214 and the opposing indentation pattern 216 may include at least one other indentation (not shown), such as at least one other array of indentations. For example, one or more of the at least one elevated portion 210B of the major surface 210 and the remaining portion 210A of the major surface 210 may include at least one additional array of indentations (not shown). Similarly, one or more of the portion of the opposing major surface 210 substantially aligned with the at least one elevated portion 210B and the another portion of the opposing major surface 210 substantially aligned with the remaining portion 210A may include at least one additional opposing array of indentations (not shown).

Each of the first array of indentations 214A, the second array of indentations 214B, the third array of indentations 214C, and the fourth array of indentations 214D may extend in substantially linear paths across at least a portion the major surface 210. Similarly, each of the first opposing array of indentations 216A, the second opposing array of indentations 214B, the third opposing array of indentations (not shown), and the fourth opposing array of indentations 216D (FIG. 2B) may extend in substantially linear paths across at least a portion the opposing major surface 212. In additional embodiments, at least one indentation of each of the indentation pattern 214 and the second indentation pattern may extend in a substantially non-linear path, in a manner similar to that described above with respect to the fragmentation body 100. In yet additional embodiments, if the indentation pattern 214 and the opposing indentation pattern 216 each include at least one other indentation, the at least one other indentation may extend in a linear path or may extend in a non-linear path.

As shown in FIG. 2A, at least a portion of each of the first array of indentations 214A, the second array of indentations 214B, the third array of indentations 214C, and the fourth array of indentations 214D may be substantially discontinuous across the major surface 210. For example, at least a portion of each of the first array of indentations 214A and the second array of indentations 214B may terminate at the at least one elevated portion 210B of the major surface 210, and each of the third array of indentations 214C and the fourth array of indentations 214D may terminate at the remaining portion 210A of the major surface 210. Similarly, each of the first opposing array of indentations 216A, the second opposing array of indentations 214B, the third opposing array of indentations (not shown), and the fourth opposing array of indentations 216D (FIG. 2B) may be substantially discontinuous across the opposing major surface 212. For example, at least a portion of each of the first opposing array of indentations 216A and the second opposing array of indentations 216B may terminate at the portion of the opposing major surface 212 substantially aligned with the at least one elevated portion 210B of the major surface 210, and each of the third opposing array of indentations (not shown) and the fourth opposing array of indentations (not shown) may terminate at the another portion of the opposing major surface 212 substantially aligned with the remaining portion 210A of the major surface 210. In additional embodiments, if the indentation pattern 214 and the opposing indentation pattern 216 each include at least one other array of indentations, at least a portion of the at least one other array of indentations may be substantially discontinuous.

As illustrated in FIG. 2A, the indentation pattern 214 may be configured such that each indentation of the first array of indentations 214A is uniformly spaced by a distance $A_2$, and such that each indentation of the second array of indentations 214B is uniformly spaced by a distance $B_2$. In addition, each indentation of the third array of indentations 214C may be uniformly spaced by a distance $A_3$, and each indentation of the fourth array of indentations 214D may be uniformly spaced by a distance $B_3$. The distance $A_3$ and the distance $B_3$ may be greater than the distance $A_2$ and the distance $B_2$, respectively. Similarly, the opposing indentation pattern 216 may be configured such that each indentation of the first opposing array of indentations 216A uniformly by the distance $A_2$, and such that each indentation of the second opposing array of indentations 216B is uniformly spaced by the distance $B_2$. In addition, each indentation of the third opposing array of indentations (not shown) may be uniformly spaced by the distance $A_3$, and each indentation of the fourth opposing array of indentations 216D (FIG. 2B) may be uniformly spaced by the distance $B_3$. A length of each of the distance $A_2$, the distance $B_2$, the distance $A_3$, and the distance $B_3$ may depend upon a desired fragmentation efficiency of the fragmentation body 200 and a desired mass of each of the interconnected fragments 218. For example, a ratio between the distance $A_2$ and a height $H_2$ (FIG. 2B) of a portion of the fragmentation body 200 may be within a range of from about 1:1 to about 3:1, such as from about 1.5:1 to about 2.5:1, or from about 1.8:1 to about 2.2:1. In addition, a ratio between the distance $A_3$ and a height $H_3$ (FIG. 2B) of another portion of the fragmentation body 200 may be within a range of from about 1:1 to about 3:1, such as from about 1.5:1 to about 2.5:1, or from about 1.8:1 to about 2.2:1. Similarly, a ratio between the distance $B_2$ and the height $H_2$ (FIG. 1B) of the portion the fragmentation body 100 may be within a range of from about 1:1 to about 3:1, such as from about 1.5:1 to about 2.5:1, or from about 1.8:1 to about 2.2:1. In addition, a ratio between the distance $B_3$ and a height $H_3$ (FIG. 2B) of the another portion of the fragmentation body 200 may be within a range of from about 1:1 to about 3:1, such as from about 1.5:1 to about 2.5:1, or from about 1.8:1 to about 2.2:1. The distance $A_2$ and the distance $B_2$ may be substantially equal or may be substantially different, and the distance $A_3$ and the distance $B_3$ may be substantially equal or may be substantially different. In further embodiments, each of the indentation pattern 214 and the opposing indentation pattern 216 may be configured such that at least one indentation is non-uniformly spaced, in a manner similar to that described above in relative to the fragmentation body 100 (FIGS. 1A and 1B). In yet further embodiments, if the indentation pattern 214 and the opposing indentation pattern 116 each include at least one other array of indentations, the at least one other array of indentations may be uniformly spaced or may be non-uniformly spaced.

Each indentation of the indentation pattern 214 and each indentation of the opposing indentation pattern 216 may have a width, depth, and shape facilitating the break-up of the interconnected fragments 218 into substantially discrete fragments (not shown) of a substantially controlled shape and of a substantially controlled size upon the occurrence of a triggering event (e.g., an explosive launch). Each indentation of the indentation pattern 214 and each indentation of the opposing indentation pattern 216 may have a width, depth, and shape substantially similar to that described above in relation to the fragmentation body 100.

Figure 2B:
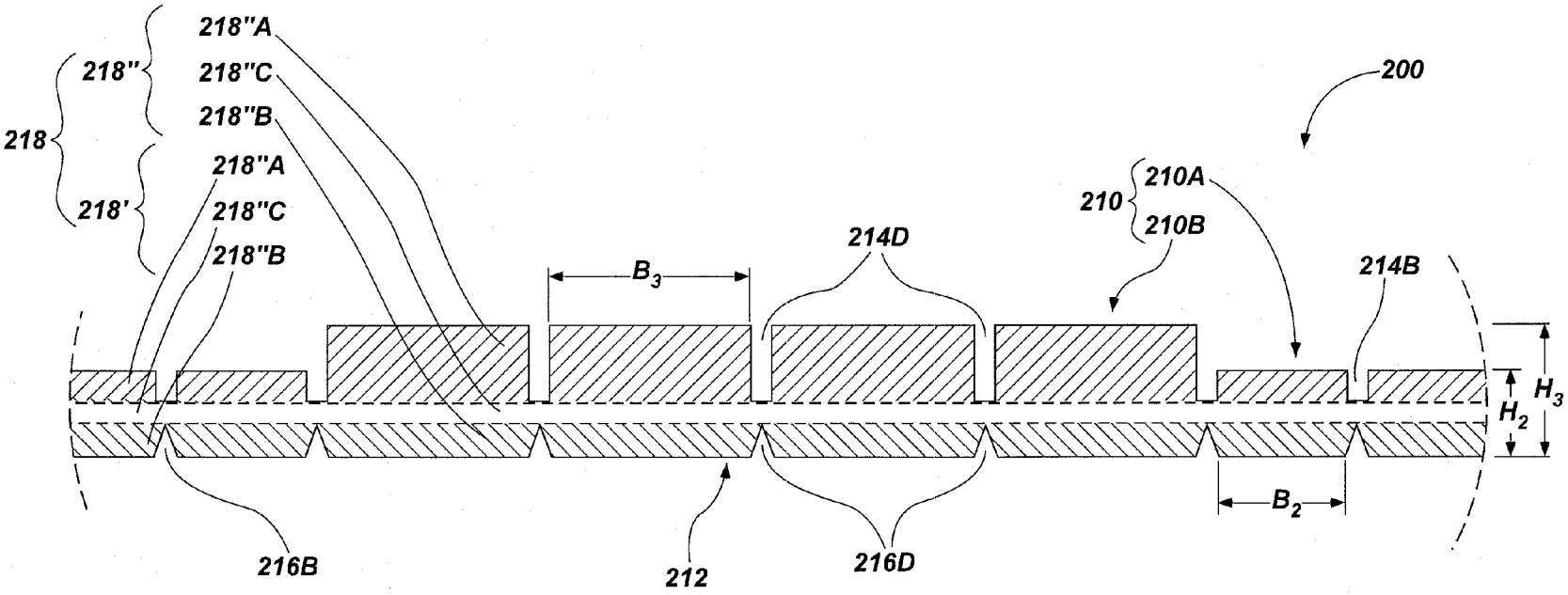
FIG. 2B is a cross-sectional view taken along a portion of line $C_2$-$C_2$ of FIG. 2A.

The indentation pattern 214 and the opposing indentation pattern 216 may at least partially define the shape and size of each of interconnected fragments 218. The interconnected fragments 218 may include small interconnected fragments 218' and large interconnected fragments 218". The shape of the interconnected fragments 218 may be substantially similar to the shape of the interconnected fragments 118 described above with respect to the fragmentation body 100. In addition, the indentation pattern 214 and the opposing indentation pattern 216 may at least partially define a length and width of each of the interconnected fragments 218. For example, as shown in FIG. 2A, each of the first array of indentations 214A and the second array of indentations 214B may at least partially define a first region 218'A (FIG. 2B) of each of the small interconnected fragments 218' to have a minimum width substantially equal to the distance $A_2$ and a minimum length substantially equal to the distance $B_2$. In addition, each of the third array of indentations 214C and the fourth array of indentations 214D may at least partially define a first region 218"A (FIG. 2B) of each of the large interconnected fragments 218" to have a minimum width substantially equal to the distance $A_3$ and a minimum length substantially equal to the distance $B_3$. Similarly, each of first opposing array of indentations 216A and the second opposing array of indentations 216B may at least partially define a second region 218'B (FIG. 2B) of each of the small interconnected fragments 218' to have a minimum width equal to the distance $A_2$ and a minimum length equal to the distance $B_2$. In addition, each of the third opposing array of indentations (not shown) and the fourth opposing array of indentations 216D (FIG. 2B) may at least partially define a second region 218"B (FIG. 2B) of each of the large interconnected fragments 218" to have a minimum width equal to the distance $A_3$ and a minimum length equal to the distance $B_3$. As shown in FIG. 2B, the small interconnected fragments 218' and the large interconnected fragments 218" may be joined together by intermediary regions 218'C, 218"C. In further embodiments, the first region 218'A (FIG. 2B) of at least one of the small interconnected fragments 218' may have at least one of a different length and a different width than the first region 218'A (FIG. 2B) of at least one other of the small interconnected fragments 218'. In addition, the first region 218"A (FIG. 2B) of at least one of the large interconnected fragments 218" may have at least one of a different length and a different width than the first region 218"A (FIG. 2B) of at least one other of the large interconnected fragments 218". In yet further embodiments, the second region 218'B (FIG. 2B) of at least one of the small interconnected fragments 218' may have at least one of a different length and a different width than the second region 218'B (FIG. 2B) of at least one other of the small interconnected fragments 218'. In addition, the second region 218"B (FIG. 2B) of at least one of the large interconnected fragments 218" may have at least one of a different length and a different width than the second region 218"B (FIG. 2B) of at least one other of the large interconnected fragments 218".

Referring to FIG. 2B, which shows a cross-sectional view of the fragmentation body 200 taken about a portion of line $C_2$-$C_2$ of FIG. 2A, the first region 218'A of each of the small interconnected fragments 218' may be of substantially equal height, and the second region 218'B of the small interconnected fragments 218' may be of substantially equal height. In addition, the first region 218"A of each of the large interconnected fragments 218" may be of substantially equal height, and the second region 218"B of each of the large interconnected fragments 218" may be of substantially equal height. A height of the first region 218"A of each of the large interconnected fragments 218" may be greater than a height of the first region 218'A of each of the small interconnected fragments 218', and a height of the second region 218"B of each of the large interconnected fragments 218" may be substantially equal to a height of the second region 218'B of each of the small interconnected fragments 218'. In further embodiments, the height of the second region 218"B of each of the large interconnected fragments 218" may be greater than the height of the second region 218'B of each of the small interconnected fragments 218', and the height of the first region 218"A of each of the large interconnected fragments 218" may be substantially equal to the height of the first region 218'A of each of the small interconnected fragments 218'. In yet further embodiments, the first region 218'A of at least one of the small interconnected fragments 218' may be of a different height than the first region 218'A of at least one other of the small interconnected fragments 218'. In addition, the first region 218"A of at least one of the large interconnected fragments 218" may be of a different height than the first region 218"A of at least one other of the large interconnected fragments 218". In yet still further embodiments, the second region 218'B of at least one of the small interconnected fragments 218' may be of a different height than the second region 218'B of at least one other of the small interconnected fragments 218'. In addition, the second region 218"B of at least one of the large interconnected fragments 218" may be of a different height than the second region 218"B of at least one other of the large interconnected fragments 218".

The dimensions of each of the interconnected fragments 218 may depend upon a desired mass for each of the interconnected fragments 218. By way of non-limiting example, the dimensions of each of the interconnected fragments 218 may be such that each of the of the interconnected fragments 218 has a mass within a range of from about 1 grain to about 30 grains, such as from about 2 grains to about 15 grains, or from about 3 grains to about 8 grains. The large interconnected fragments 218" may have a greater mass than the small interconnected fragments 218'. In at least some embodiments, each of the large interconnected fragments 218" has a mass of about 8 grains and each of the small interconnected fragments 218' has a mass of about 3 grains.

The interconnected fragments 218 may be arranged in a substantially organized manner. For example, as shown in FIG. 2A, the small interconnected fragments 218' may be arranged as a first matrix of columns (not numbered) and rows (not numbered), and the large interconnected fragments 218" may be arranged as second matrix of other columns (not numbered) and other rows (not numbered). Each of the columns and each of the other columns may run substantially perpendicular to each of the rows and each of the other rows, respectively. Each of the columns may run in a substantially similar direction as each of the other columns, and each of the rows may run in a substantially similar direction as each of the other rows. In further embodiments, each of the columns may run in a substantially different direction than each of the other columns, and each of the rows may run in a substantially different direction than each of the other columns. As depicted in FIG. 2A, at least some of the columns may be substantially different (e.g., substantially different size, substantially different shape, etc.), and at least some of the rows may be substantially different. In addition, each of the other columns may be substantially similar, and each of the other rows may be substantially similar. In yet further embodiments, at least one of the other columns may be substantially different, and at least one of the other rows may be substantially different. In yet still further embodiments, at least a portion of the interconnected fragments 218 may be arranged in a substantially disorganized manner.

Figure 3A:
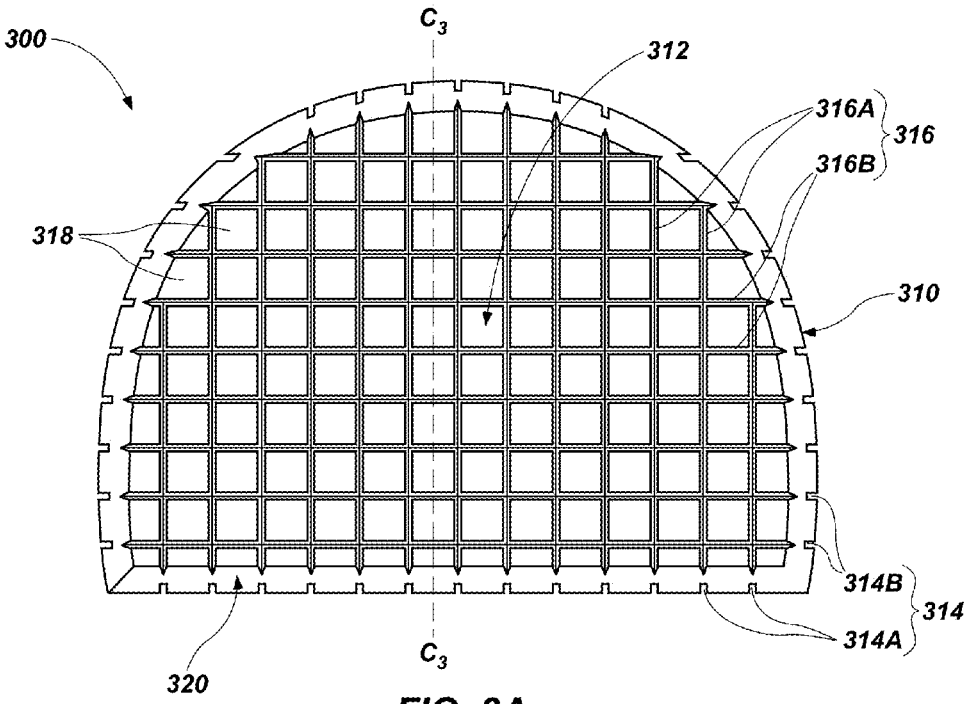
FIG. 3A is a bottom view of a fragmentation body in accordance with another embodiment of the present disclosure.
Figure 3B:
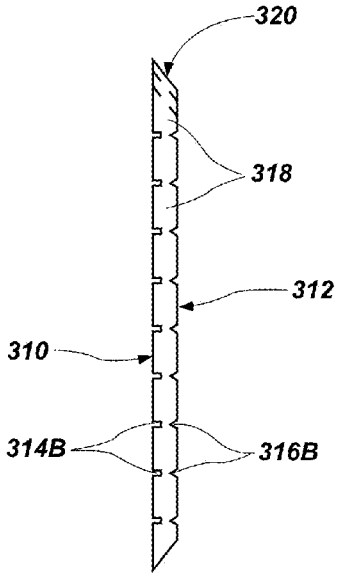
FIG. 3B is a cross-sectional view taken along line $C_3$-$C_3$ of FIG. 3A.

FIG. 3A illustrates a bottom view of a fragmentation body 300 in accordance with another embodiment of the present disclosure. The fragmentation body 300 includes a major surface 310, an opposing major surface 312, and at least one major peripheral sidewall 320. The fragmentation body 300 has a generally semicircular peripheral shape. The major surface 310 may have a larger surface area than the opposing major surface 312, enabling the at least one major peripheral sidewall 320 to run substantially non-perpendicular to each of the major surface 310 and the opposing major surface 312. An indentation pattern 314 extending across the major surface 310 and an opposing indentation pattern 316 extending across the opposing major surface 312 may at least partially define interconnected fragments 318, as previously described herein. In addition, the peripheral shape of the fragmentation body 300 may at least partially define one or more of the interconnected fragments 318. For example, as depicted in FIG. 3A, the generally semicircular peripheral shape of the fragmentation body 300 may at least partially enable one or more of the interconnected fragments 318 (e.g., interconnected fragments 318 adjacent the at least one major peripheral sidewall 320) to be of a different size and a different shape than at least some other of the interconnected fragments 318. FIG. 3B illustrates a cross-sectional view of the fragmentation body 300 taken about line $C_3$-$C_3$ in FIG. 3A.

Figure 4:
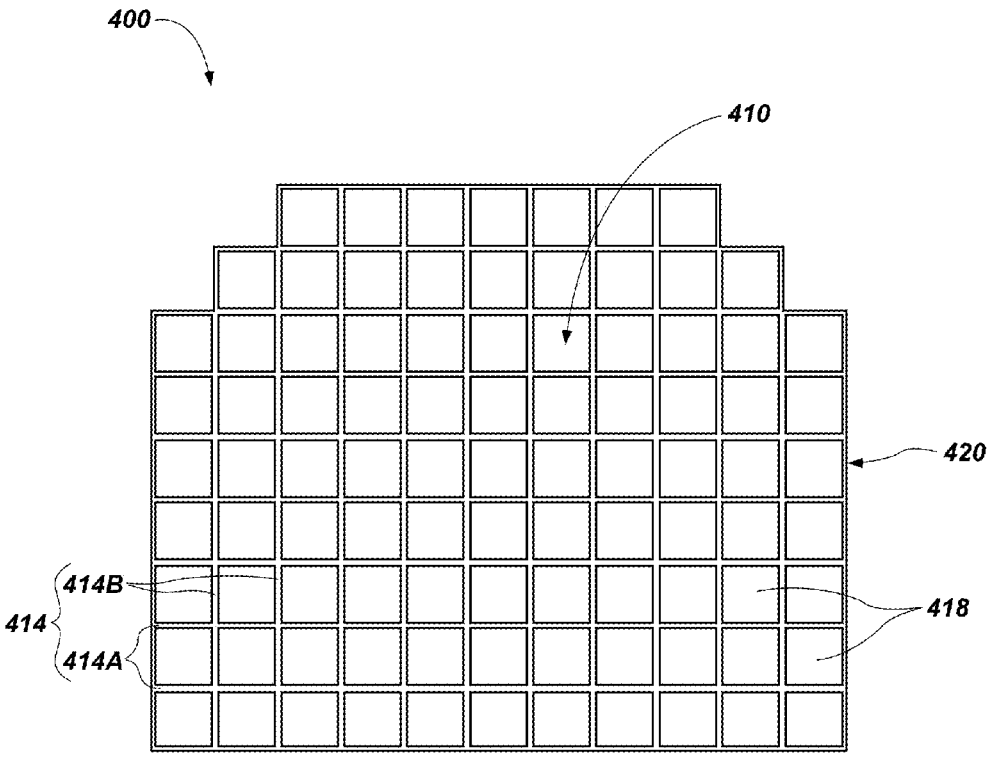
FIG. 4 is a top view of a fragmentation body in accordance with another embodiment of the present disclosure.

FIG. 4 illustrates a top-down view of a fragmentation body 400 in accordance with another embodiment of the present disclosure. The fragmentation body 400 includes a major surface 410, an opposing major surface (not shown), and at least one major peripheral sidewall 420. The fragmentation body 400 has an irregular peripheral shape. An indentation pattern 414 extending across the major surface 410 and an opposing indentation pattern (not shown) extending across the opposing major surface 412 may at least partially define interconnected fragments 418, as previously described herein. In addition, the peripheral shape of the fragmentation body 400 may at least partially define one or more of the interconnected fragments 418. For example, as depicted in FIG. 4, the irregular peripheral shape of the fragmentation body 400 may at least partially enable the interconnected fragments 418 of the fragmentation body 400 to be of substantially equal size (i.e., a mono-modal size distribution of the interconnected fragments 418). In additional embodiments, such as embodiments where indentations of the indentation pattern 414 and the opposing indentation pattern (not shown) are one or more of non-uniformly spaced, non-linear, and discontinuous, the irregular peripheral shape of the fragmentation body 400 may enable at least one of the interconnected fragments 418 (e.g., interconnected fragments 418 adjacent the at least one major peripheral sidewall 420) to be of a different size and a different shape than at least one other of the interconnected fragments 418.

Figure 5A:
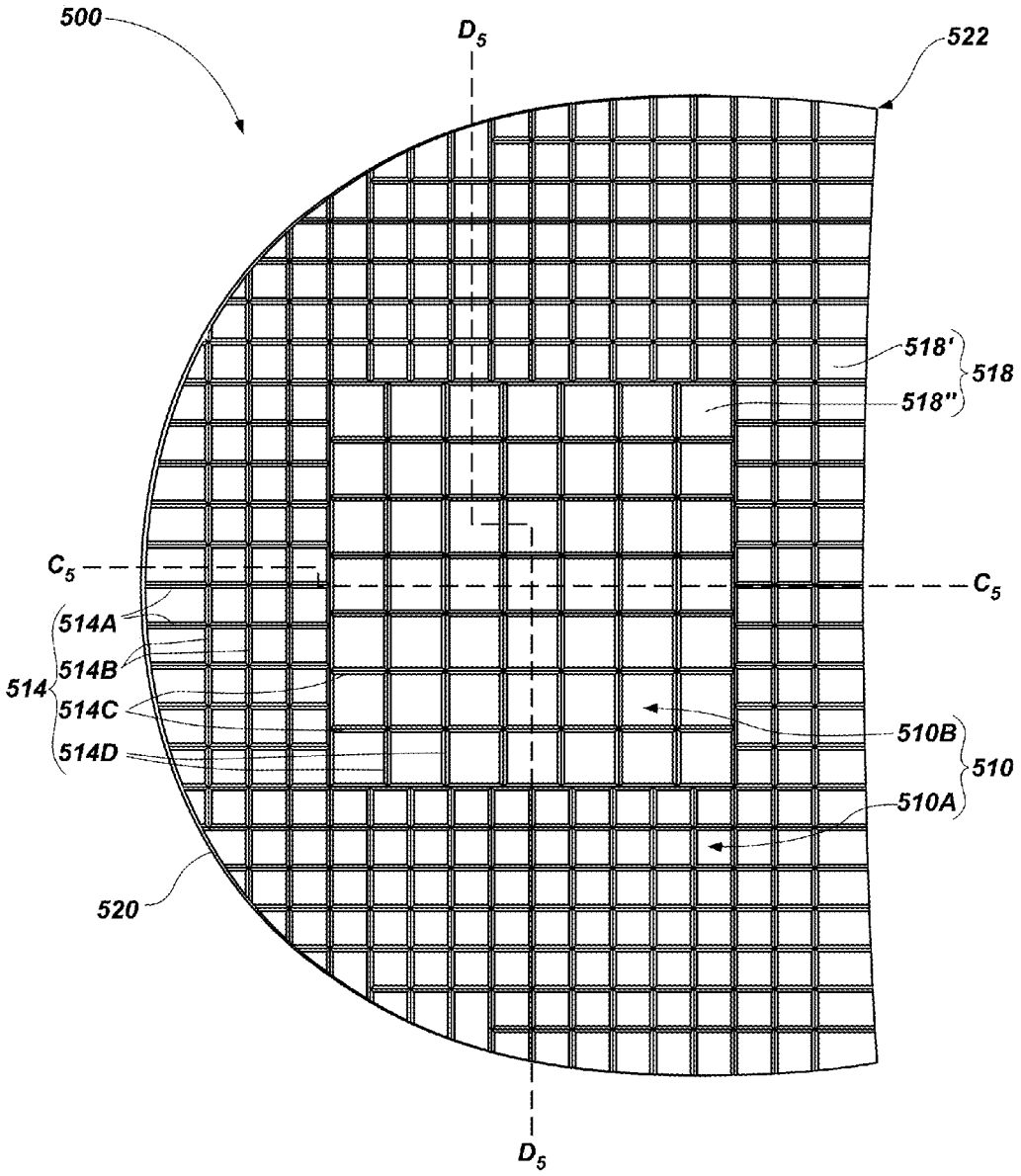
FIG. 5A is a top view of a fragmentation body in accordance with another embodiment of the present disclosure.
Figure 5B:
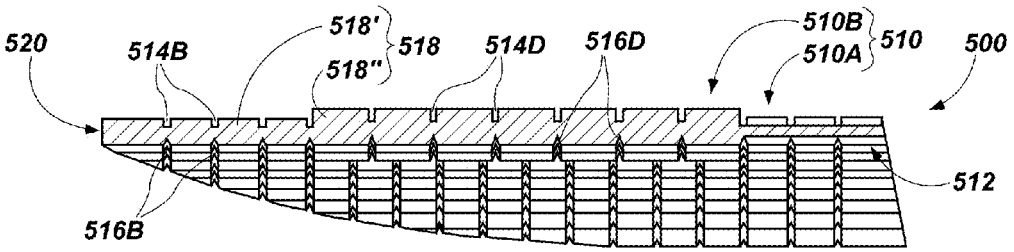
FIG. 5B is a cross-sectional view taken along line $C_5$-$C_5$ of FIG. 5A.
Figure 5C:
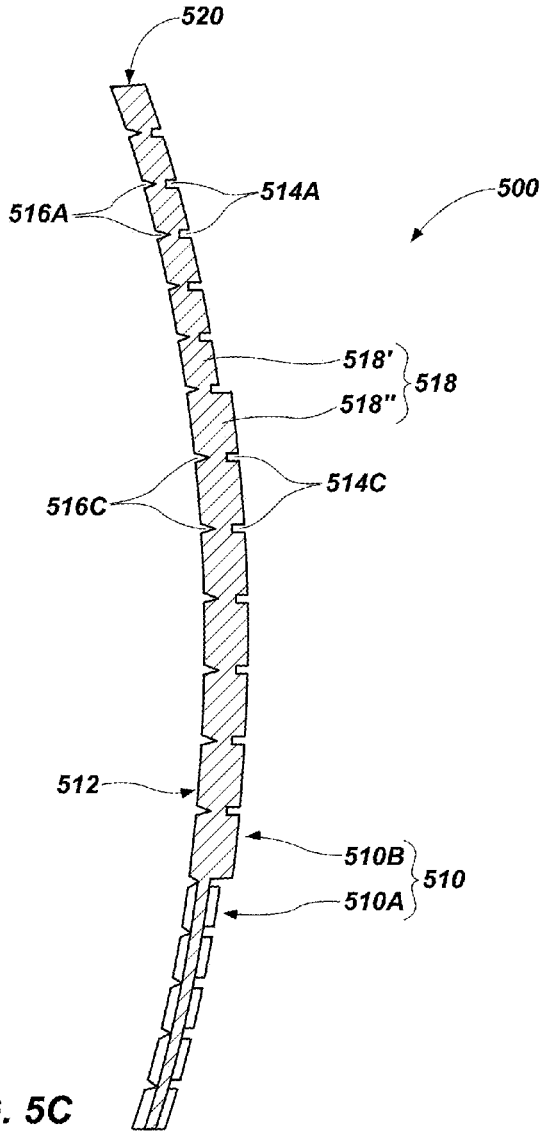
FIG. 5C is a cross-sectional view taken along line $D_5$-$D_5$ of FIG. 5A.

FIG. 5A is a top-down view of a fragmentation body 500 in accordance with another embodiment of the present disclosure. The fragmentation body 500 has a generally semicircular shape and includes a major surface 510, an opposing major surface 512 (FIGS. 5B and 5C), and at least one major peripheral sidewall 520. The major surface may include at least one elevated portion 510B and a remaining portion 510A, substantially similar to the at least one elevated portion 210B and the remaining portion 210A described above with respect to the fragmentation body 200. In addition, the major surface 510 may include each of an indentation pattern 514 and an opposing indentation pattern (not shown), which at least partially define interconnected fragments 518 (e.g., small interconnected fragments 518' and large interconnected fragments 518") in a manner substantially similar to that described above with respect to the fragmentation body 200. Referring to each of FIGS. 5B and 5C, which show cross-sectional views of the fragmentation body 500 taken about line $C_5$-$C_5$ of FIG. 2A and line $D_5$-$D_5$ of FIG. 2A, respectively, the fragmentation body 500 may be substantially curved or arcuate. As shown in FIG. 5C, the major surface 510 may be substantially convex and the opposing major surface 512 may be substantially concave. The fragmentation body 500 may have any desired radius of curvature. The radius of curvature may be substantially constant or may vary across at least one of a length and a width of the fragmentation body 500.

Figure 6A:
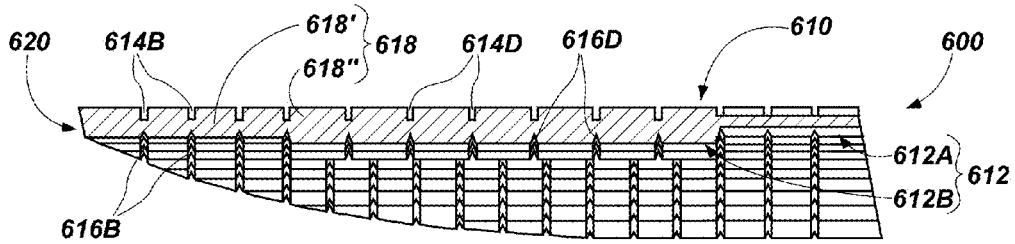
FIG. 6A is a cross-sectional view of a fragmentation body in accordance with another embodiment of the present disclosure.
Figure 6B:
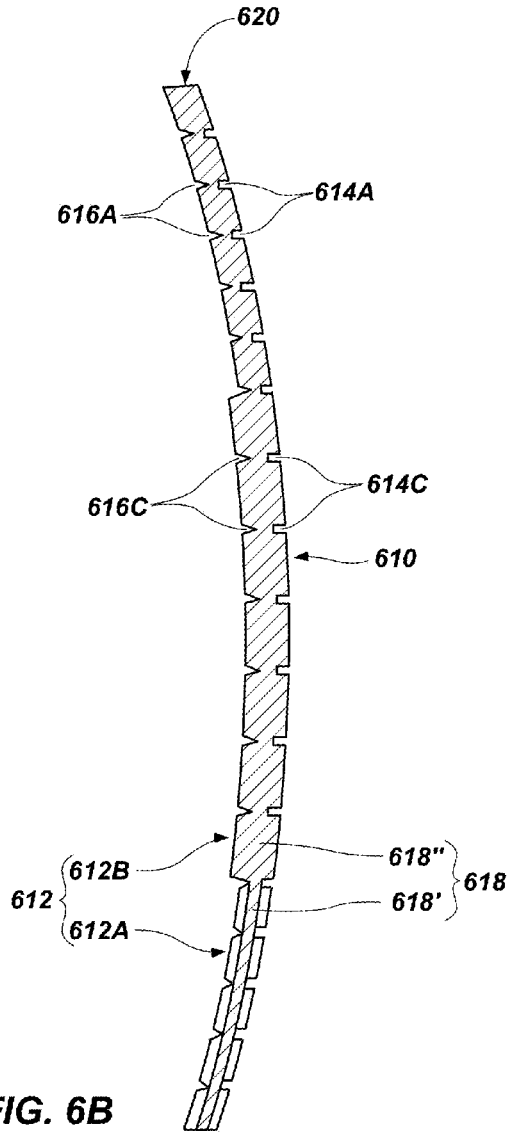
FIG. 6B is another cross-sectional view of the fragmentation body depicted in FIG. 6A.

FIG. 6A is a cross-sectional view of a fragmentation body 600 in accordance with another embodiment of the present disclosure. The fragmentation body 600 has a generally semicircular shape and includes a major surface 610, an opposing major surface 612, and at least one major peripheral sidewall 620. The fragmentation body 600 may be substantially curved or arcuate. The fragmentation body 600 may be substantially similar to the fragmentation body 500 described above, with regard to FIGS. 5A and 5B, except that the opposing major surface 612 includes at least one opposing elevated portion 612B and an opposing remaining portion 612A. As depicted in FIG. 6A, the major surface 610 does not include at least one elevated portion and a remaining portion. However, in additional embodiments, the major surface 610 may include at least one elevated portion and a remaining portion, substantially similar to the at least one elevated portion 510B and a remaining portion 510A described above with respect to the fragmentation body 500.

The fragmentation bodies 100, 200, 300, 400, 500, 600 of the present disclosure may be formed of and include a metal material. The metal material may impart fragments formed from the fragmentation bodies 100, 200, 300, 400, 500, 600 with at least one of a desired penetration efficiency and desired incendiary properties. The metal material may be substantially inert, or may be substantially reactive. As used herein, the term "substantially inert" means and includes a material substantially incapable of producing a strong exothermic chemical reaction (e.g., an incendiary reaction). As used herein, the term "substantially reactive" means and includes a material substantially capable of producing a strong exothermic chemical reaction. In at least some embodiments, the metal material is substantially inert. The metal material may include at least one high-density metal. As used herein, the term "high-density metal" means and includes a metal or semi-metal (i.e., metalloid) having a density greater than or equal to the density of magnesium (about 1.74 g/cm$^3$), such as greater than or equal to the density of titanium (about 4.5 g/cm$^3$), or greater than or equal to the density of zirconium (about 6.5 g/cm$^3$), or greater than or equal to the density of lead (about 11.3 g/cm$^3$), or greater than or equal to the density of hafnium (about 13.3 g/cm$^3$). Non-limiting examples of suitable high-density metals include magnesium (Mg), aluminum (Al), iron (Fe), copper (Cu), nickel (Ni), palladium (Pd), platinum (Pt), copper (Cu), silver (Ag), gold (Au), zirconium (Zr), titanium (Ti), zinc (Zn), boron (B), silicon (Si), cobalt (Co), manganese (Mn), tin (Sn), bismuth (Bi), lead (Pb), hafnium (Hf), tungsten (W), depleted uranium, tantalum (Ta), alloys thereof, carbides thereof, oxides thereof, or nitrides thereof. In at least some embodiments, the at least one high-density metal is a tungsten-based alloy. As used herein, the term "tungsten-based alloy" means and includes a metal alloy including greater than or equal to about 50 percent by weight of W, such as greater than or equal to about 75 percent by weight of W, or greater than or equal to about 90 percent by weight of W. In addition to W, the tungsten-based alloy may include at least one other metal, such as a lower melting point metal (e.g., a Group VIIIB metal, such as Fe, Co, Ni, Pd, or Pt; a Group IB metal, such as Cu, Ag, or Au; Zn; Al; Sn; Bi) that may interact with the W to form an alloy exhibiting at least one of a desired density, a desired strength, and a desired ductility. In at least some embodiments, the at least one other metal includes Ni and at least one of Fe and Cu. At least where the metal material is substantially reactive, the metal material may also include at least one oxidizing agent. The oxidizing agent may be a strong oxidizer, such that a strong exothermic reaction (e.g., an incendiary reaction) occurs when the fragments formed from the fragmentation bodies 100, 200, 300, 400, 500, 600 penetrate at least one target. Non-limiting examples of suitable oxidizing agents include potassium perchlorate, ammonium perchlorate, ammonium nitrate, potassium nitrate, cesium nitrate, strontium nitrate, strontium peroxide, barium nitrate, barium peroxide, cupric oxide, and basic copper nitrate (BCN). In addition, embodiments of the fragmentation bodies 100, 200, 300, 400, 500, 600 may, optionally, be at least partially coated with at least one of a substantially inert material and a substantially reactive material.

The fragmentation bodies 100, 200, 300, 400, 500, 600 of the present disclosure may be formed using a variety of methods or processes, such as a conventional injection molding and sintering process. By way of non-limiting example, at least one high-density metal, at least one lower melting point metal (e.g., a lower melting point than the at least one high-density metal), at least one binder material, and any other desired components (e.g., an oxidizing agent) may be combined to form a substantially homogeneous mixture having a desired consistency. At least each of the high-density metal and the lower melting point metal may be provided as powders having desired size, shape, and distribution properties. Particles of each of the powders of the substantially homogeneous mixture may be substantially monodisperse, wherein all of the particles are substantially the same size, or may be polydisperse, wherein the particles have a range of sizes and are averaged. In addition, particles of each of the powders of the substantially homogeneous mixture may independently be of any desired shape, such as spherical, granular, polyhedral, acicular, spindle, grain, flake, scale, or plate. Particles of each of the powders of the substantially homogeneous mixture may have substantially similar shapes, or may have substantially different shapes. The at least one binder material may be any conventional binder material, such as a low-melting point hydrocarbon-based material (e.g., waxes, such as carnauba wax, paraffin, etc.; polymers, such as polyethylene, polypropylene, etc.; plastics; or combinations thereof), which may facilitate the formation of a "green" fragmentation body of a desired geometric configuration and which may be removed prior to sintering, as described below. The at least one binder material may be provided in a liquid or other flowable state, or may be provided in a solid state and subjected to subsequent heating to transform the at least one binder material into a flowable state.

The substantially homogeneous mixture may be injected into a mold cavity of a desired shape or geometric configuration. Upon cooling, the substantially homogeneous mixture may form a green fragmentation body having the shape of the mold cavity. While forming of the green fragmentation body using an injection molding process is described above, other processes may be used to form the green fragmentation body including, but not limited to, compacting, transfer molding, or extruding.

The green fragmentation body may subsequently be subjected to conventional debinding operations to remove the at least one binder material and form a pre-sintered fragmentation body substantially free of the binder material. The debinding and pre-sintering operations may utilize at least one of heat, an inert gas, and a solvent to remove the at least one binder material. By way of non-limiting example, the green fragmentation body may be heated at a temperature below the melting point of each of the at least one high-density metal and the at least one lower melting point metal, but sufficient to volatilize or decompose the at least one binder material.

The pre-sintered fragmentation body may be subjected to a sintering process to form a substantially fully sintered fragmentation body. The sintering process may be performed at a temperature above an incipient liquid phase sintering temperature of the pre-sintered fragmentation body. As used herein, the term "incipient liquid phase sintering temperature," means and includes the minimum temperature effective for liquid phase sintering of a metal material. As used herein, the term "liquid phase sintering" means and includes a sintering process for a metal material wherein a liquid phase is present during at least part of the sintering process. By way of non-limiting example, the sintering process may be performed at a temperature within a range of from about 1200° C. to about 1600° C. Both solid state bonding and liquid phase bonding may occur at surfaces of particles of the at least one high-density metal. During the sintering process, the pre-sintered fragmentation body shrinks in a predictable manner based on a density differential between the pre-sintered fragmentation body and the substantially fully sintered fragmentation body. The substantially fully sintered fragmentation body may be used as one of the fragmentation bodies 100, 200, 300, 400, 500, 600 described above, or the substantially fully sintered fragmentation body may be subjected to further treatment (e.g., etching or machining one or more indentations) to form one of the fragmentation bodies 100, 200, 300, 400, 500, 600 described above. The sintering process facilitates the strength, cohesiveness, hardness, ductility, and other significant properties of the fragmentation bodies 100, 200, 300, 400, 500, 600. The fragmentation bodies 100, 200, 300, 400, 500, 600 may at least have sufficient strength to withstand subsequent handling operations (e.g., placement in a warhead containment) without substantially fragmenting or breaking apart in an unintended way.

In additional embodiments, a plurality of separate green fragmentation bodies may be debound and pre-sintered to form a plurality of separate pre-sintered fragmentation bodies. The plurality of separate pre-sintered fragmentation bodies may then be arranged relative to each other in a desired configuration. In the desired configuration, each of the plurality of separate pre-sintered fragmentation bodies may contact or abut at least one other of the plurality of separate pre-sintered fragmentation bodies. The arranged plurality of separate pre-sintered fragmentation bodies may then be subjected to a sintering process substantially similar to that described above to form a substantially fully sintered fragmentation body, which may be used as one of the fragmentation bodies 100, 200, 300, 400, 500, 600 described above, or which may be subjected to further treatment (e.g., etching or machining one or more indentations) to form one of the fragmentation bodies 100, 200, 300, 400, 500, 600 described above.

Figure 7A:
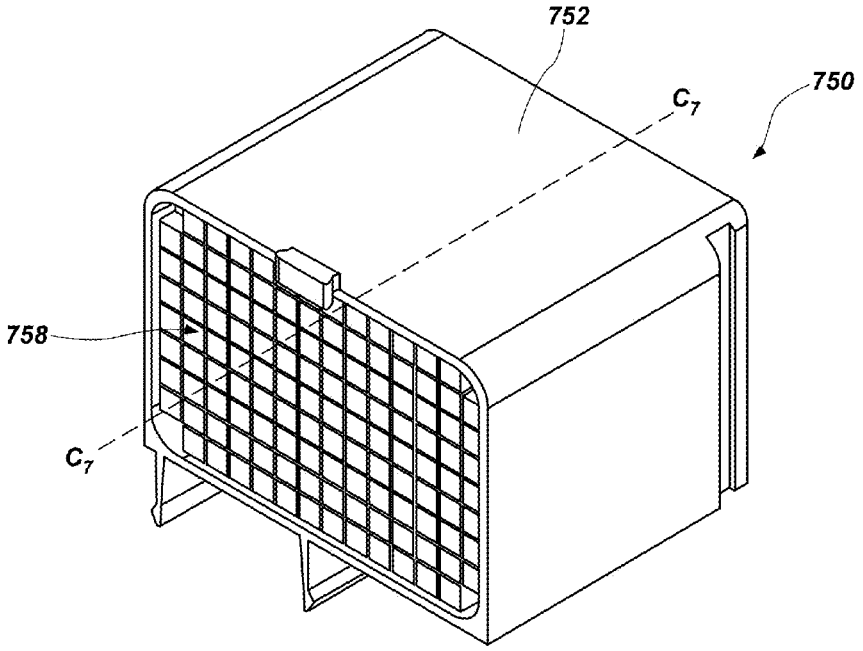
FIG. 7A is a perspective view of a warhead in accordance with an embodiment of the present disclosure.
Figure 7B:
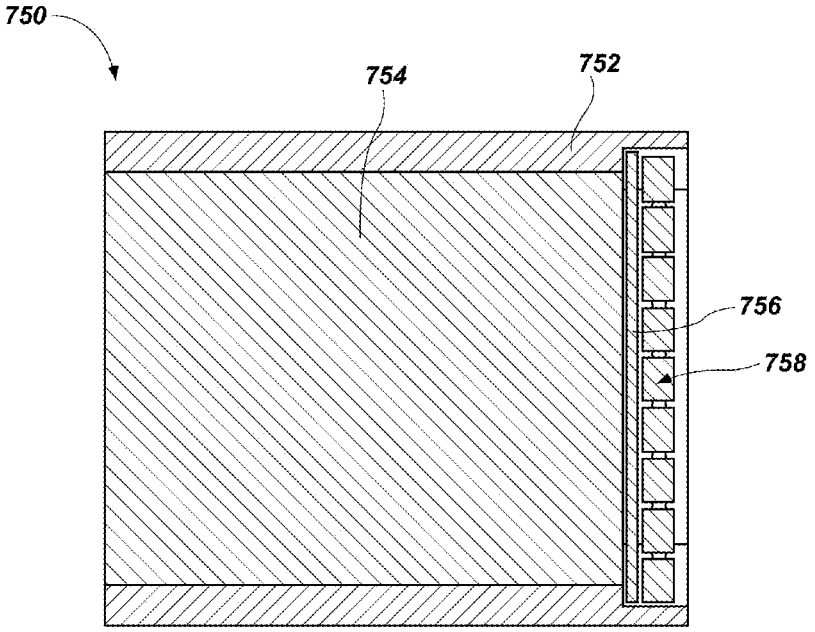
FIG. 7B is a cross-sectional view taken along line $C_7$-$C_7$ of FIG. 7A.

FIG. 7A illustrates a perspective view of a warhead 750 in accordance with an embodiment of the present disclosure. Referring to FIG. 7B, which illustrates a cross-sectional view of the warhead 750 of FIG. 7A taken about line $C_7$-$C_7$, the warhead 750 may include a containment 752, an explosive charge 754, at least one barrier material 756, and at least one fragmentation body 758. The warhead 750 may also include an initiation mechanism (not shown), as is conventional. While the warhead 750 depicted in FIGS. 7A and 7B as having a substantially cubic or rectangular shape, the warhead 750 may have a different shape, such as a puck, a disc, a sphere, a plate, a prism, an annulus, a cone, a pyramid, or a complex shape. The warhead 750 may be configured to disperse or scatter a plurality of discrete fragments (not shown) formed by the controlled break-up of the fragmentation body 758 in one of a substantially omnidirectional pattern and a substantially focused directional pattern.

The explosive charge 754 may be any suitable explosive known in art that may be cast, machined, or packed to fit within the containment 752. By way of non-limiting example, the explosive charge 754 may be an explosive including 1,3,5,7-tetraaza-1,3,5,7-tetranitrocyclooctane (HMX), such as PBX-9011, PBX-9404-3, PBX-9501, LX-04-1, LX-07-2, LX-09-1, LX-10-0, LX-10-1, LX-11, LX-14, and Octol 75/25; an explosive including 1,3,5-triaza-1,3,5-trinitrocyclohexane (RDX), such as PBX-9007, PBX-9010, PBX-9205, PBX-9407, PBX-9604, HBX-1, HBX-3, Comp A-3, Comp A-5, Comp B, Comp B-3, Comp C-3, Comp C-4, XTX-8004, H-6, Cyclotol 75/25, and Cyclotol 60/40; an explosive including 2,4,6-trinitrotoluene (TNT), such as Pentolite 50/50, Minol-2, and Boracitol; or combinations thereof. In at least some embodiments, the explosive is Comp C-4.

Comp C-4 includes approximately 91 percent RDX along with waxes and oils. The at least one barrier material 756 may be located on the explosive charge 754. The barrier material 756 serves as a buffer between the explosive charge 754 and the at least one fragmentation body 758. As a non-limiting example, the at least one barrier material 756 may be formed of and include a metallic material, such at least one of aluminum and steel. In at least some embodiments, the at least one barrier material 756 is an aluminum plate. The at least one fragmentation body 758 may be provided on the at least one barrier material 756 and may be substantially similar to an embodiment of at least one of the fragmentation bodies 100, 200, 300, 400, 500, and 600 described above. The at least one fragmentation body 758 may be bound or coupled to the at least one barrier material 756 using a suitable adhesive, such as at least one of an epoxy adhesive and a urethane adhesive. Suitable epoxy adhesives are commercially available from numerous sources, such as from Henkel Locktite Corp., (Rocky Hill, Conn.) under the LOCTITE-HYSOLT™, E-20HP™ and E-30CL™ trade names, and from Royal Adhesives and Sealants (Bellville, N.J.) under the HARDMAN® trade name. Suitable urethane adhesives are also commercially available from numerous sources, such as from Resin Technology Group, LLC (South Easton, Mass.) under the Ura-Bond 24N trade name. In additional embodiments, the at least one barrier material 756 may be omitted, and the at least one fragmentation body 758 may be substantially unbuffered relative to the explosive charge 754 (e.g., the at least one fragmentation body 758 may be provided on the explosive charge 754).

Figure 8A:
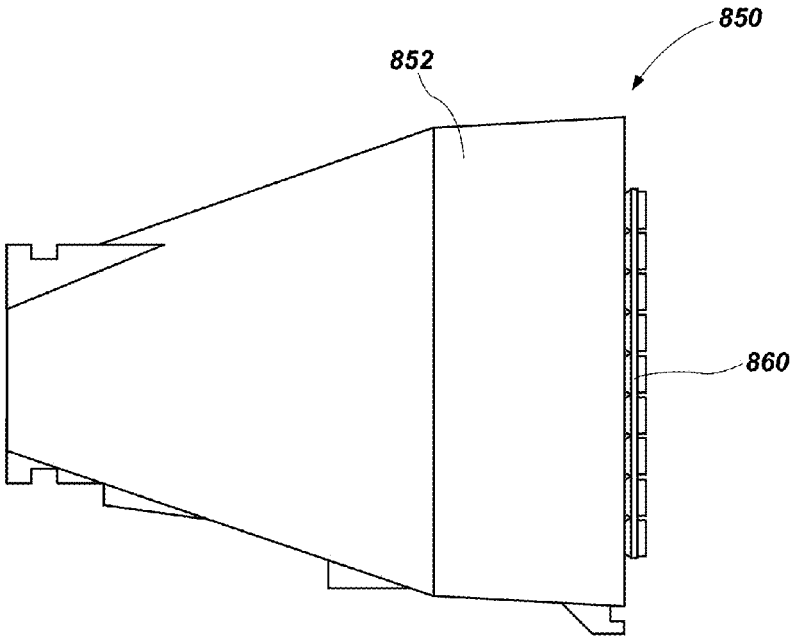
FIG. 8A is a side-elevation view of a warhead in accordance with another embodiment of the present disclosure.
Figure 8B:
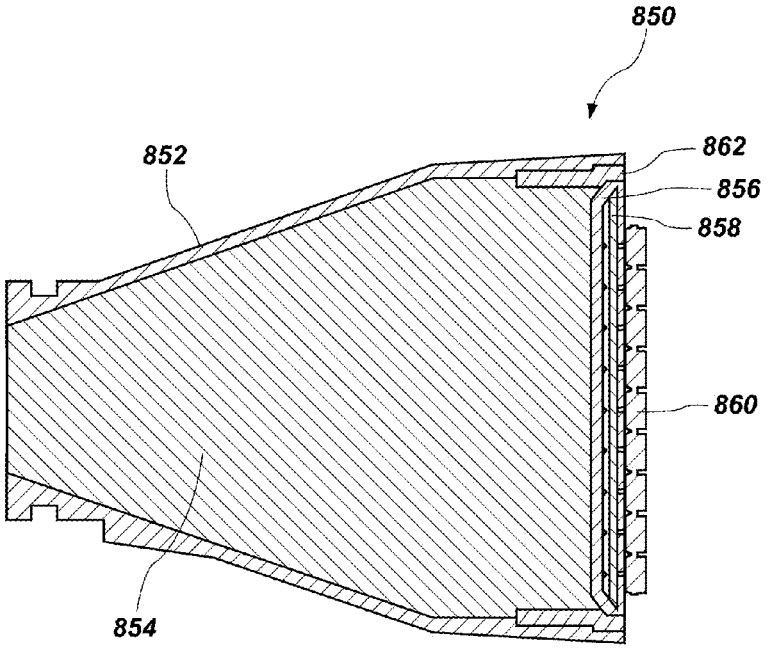
FIG. 8B is a cross-sectional view of the warhead depicted in FIG. 8A.
Figure 8C:
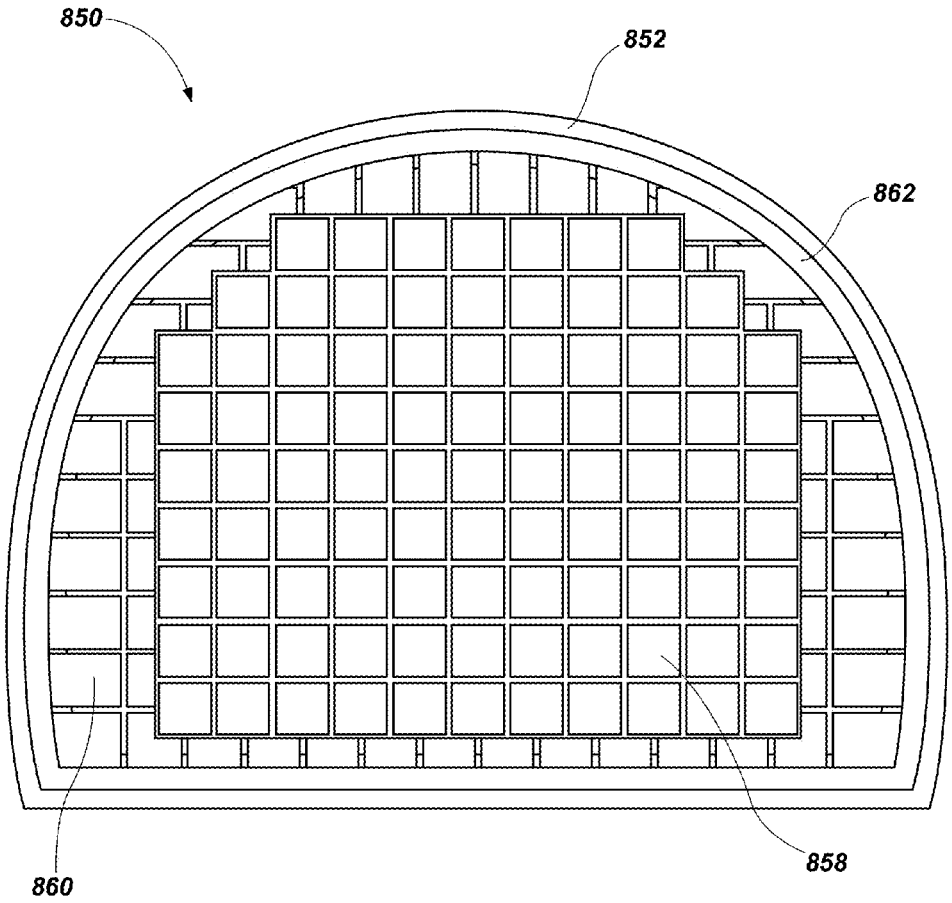
FIG. 8C is a bottom view of the warhead depicted in FIG. 8A.

FIG. 8A illustrates a perspective view of a warhead 850 in accordance with another embodiment of the present disclosure. Referring to FIG. 8B, which illustrates a cross-sectional view of the warhead 850 of FIG. 8A, the warhead 850 may include a containment 852, an explosive charge 854, at least one barrier material 856, a first fragmentation body 858, a second fragmentation body 860, and seals 862. The warhead 850 may further include an initiation mechanism (not shown), as is conventional. The explosive charge 854 may be disposed within the containment 852, the at least one barrier material 856 may be provided on the explosive charge 854, the first fragmentation body 858 may be provided on the at least one barrier material 856, and the second fragmentation body 860 may be provided on the first fragmentation body 858. Each of the explosive charge 854 and the at least one barrier material 856 may be substantially similar to the explosive charge 754 and the at least one barrier material 754 described above with regard to FIG. 7B, respectively. In additional embodiments, the at least one barrier material 854 may be omitted. The first fragmentation body 858 and the second fragmentation body 860 may each independently be substantially similar to one of the fragmentation bodies 100, 200, 300, 400, 500, and 600 described above. In further embodiments, the warhead 850 may include at least one additional fragmentation body (not shown). In yet further embodiments, one of the first fragmentation body 858 and the second fragmentation body 860 may be omitted. FIG. 8C illustrates a bottom view of the warhead 850, more clearly showing each of the first fragmentation body 858 and the second fragmentation body 860.

The first fragmentation body 858 and the second fragmentation body 860 may be formed of and include the same material, or the first fragmentation body 858 may be formed of and include a different material than the second fragmentation body 860. By way of non-limiting example, the first fragmentation body 858 may be formed of and include a substantially inert metal material, and the second fragmentation body 860 be formed of and include a different substantially inert metal material. As an additional non-limiting example, one of first fragmentation body 858 and the second fragmentation body 860 may be formed of and include a substantially reactive metal material and while the other of the first fragmentation body 858 and the second fragmentation body 860 may be formed of and include a substantially inert metal material. As yet an additional non-limiting example, the first fragmentation body 858 may be formed of and include a substantially reactive metal material, and the second fragmentation body 860 be formed of and include a different substantially reactive metal material. As yet still an additional non-limiting example, each of the first fragmentation body 858 and the second fragmentation body 860 may be formed of and include the same substantially inert metal material, or may be formed of and include the same substantially reactive metal material.

Each of the first fragmentation body 858 and the second fragmentation body 860 may be configured such that a first plurality of discrete fragments (not shown) formed from the controlled break-up of the first fragmentation body 858 exhibits one or more different properties than a second plurality of discrete fragments (not shown) formed from the controlled break-up of the second fragmentation body 860. For example, each of first fragmentation body 858 and the second fragmentation body 860 may be configured such that a velocity differential exists between the first plurality of discrete fragments and the second plurality of discrete fragments upon a detonation or explosive launch of the warhead 850. At least a portion of one of the first plurality of discrete fragments and the second plurality of discrete fragments may travel at a slower velocity than at least a portion of the other of the first plurality of discrete fragments and the second plurality of discrete fragments. The velocity differential may enable faster moving fragments to reach at least one target first and prepare the at least one target for subsequent action by the slower moving fragments. Various factors may affect the velocity differential between the first plurality of discrete fragments and the second plurality of discrete fragments. For example, the velocity differential may be influenced by one or more of the geometric configuration of each of the first fragmentation body 858 and the second fragmentation body 860 prior to explosive launch, the arrangement of the first fragmentation body 858 relative to the second fragmentation body 860 prior to explosive launch, at least one of the density and the surface roughness of the first fragmentation body 858 as compared to the second fragmentation body 860, and at least one of sizes and shapes of the first plurality of discrete fragments relative to sizes and shapes of the second plurality of discrete fragments. One or more of the various factors above may also effectuate a velocity differential between at least one of different fragments of the first plurality of discrete fragments and different fragments of the second plurality of discrete fragments.

Figure 9:
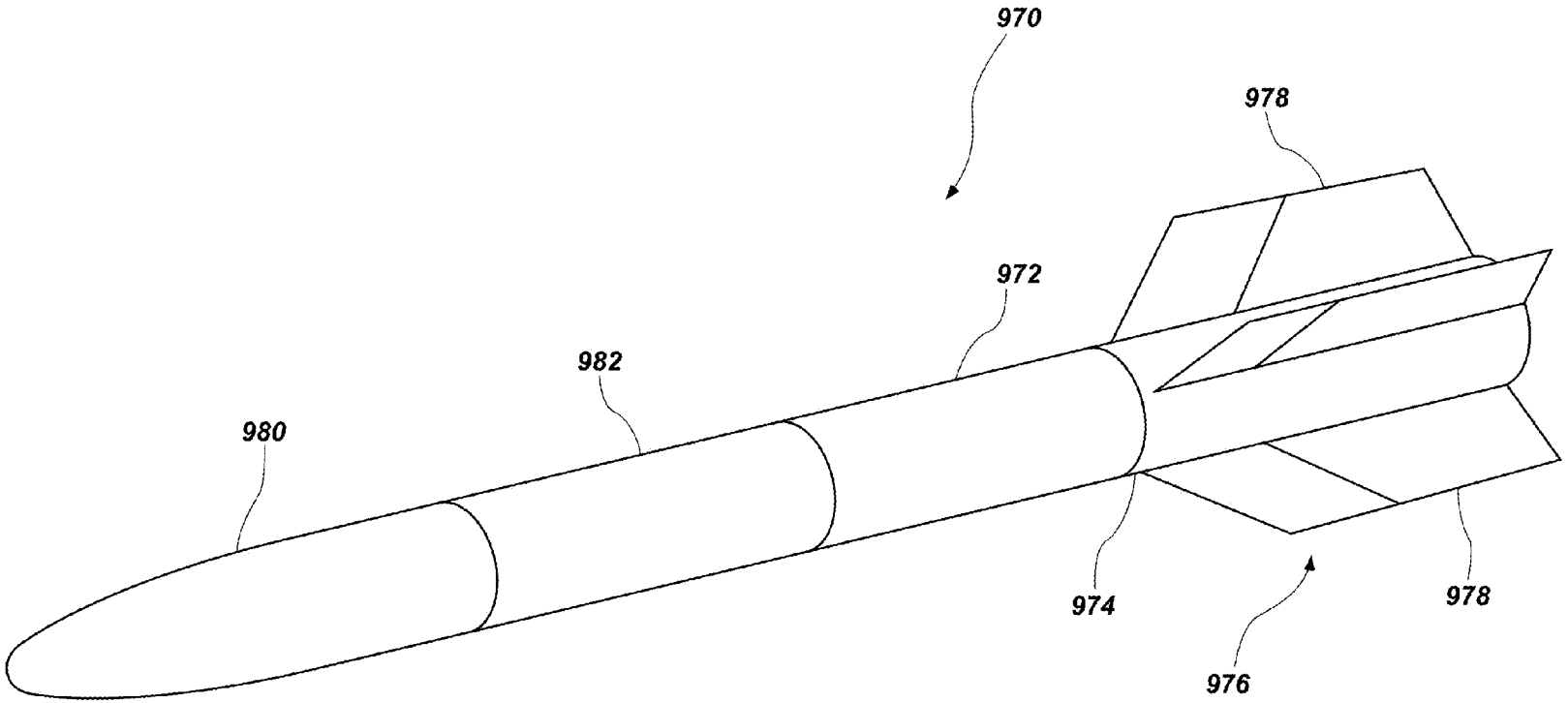
FIG. 9 is a perspective view of a weapon in accordance with an embodiment of the present disclosure.

FIG. 9 illustrates a perspective view of an ordnance 970 in accordance with embodiment of the present disclosure. The ordnance 970 may be configured as a rocket or missile and may include multiple sections or components. For example, the ordnance 970 may include a rocket motor 972 that may contain a propellant (not shown), such as a liquid fuel or a solid fuel to propel the ordnance 970. In additional embodiments, the rocket motor 972 may be configured to propel the ordnance using electric propulsion. The ordnance 970 may further include a tail section 974 including at least one nozzle (not shown) cooperatively configured with the rocket motor 972 to produce a desired thrust, as well as a wing or fin assembly 976 configured to assist in controlling the flight pattern of the ordnance 970. In one or more embodiments, the fin assembly 976 includes a plurality of adjustable fins 978 to selectively alter the course of flight of the ordnance 970. In additional embodiments, the fin assembly 976 may extend beyond the tail section 974 of the ordnance 970. In yet additional embodiments, at least one component associated with the rocket motor 972 (e.g., the at least one nozzle) may be adjustable to selectively alter the course of flight of the ordnance 970. A rolleron assembly (not shown) or other stabilizing structure may be associated, for example, with the fin assembly 976, to stabilize the ordnance 970 during flight as will be appreciated by those of ordinary skill in the art. The ordnance 970 may further include a forward or nose section 980 that may house a guidance/control system (not shown) configured to direct the ordnance 970 along a desired flight path, such as by controlling one or more of the fin assembly 976 and the at least one component associated with the rocket motor 972 (e.g., the at least one nozzle). The control system may include various sensors that may be used in detecting at least one target and, further may include communication equipment configured to transmit and receive information related to the flight or status of the ordnance 970 as well as information gathered relating to the at least one target. In addition, the ordnance 970 may include a warhead 982 configured to be detonated at a specific time in an effort to defeat the at least one target. Depending on the desired use of the ordnance 970, the warhead 982 may be configured to detonate upon impact of the ordnance 970 with the at least one target, or it may be configured to be detonated at a desired time, such as when the ordnance 970 is located within a desired distance of the at least one target. In the case of the latter, the control system may include or be associated with appropriate detonating equipment to effect the desired detonation of the warhead 982 as will be appreciated by those of ordinary skill in the art. The warhead 982 may be substantially similar to the warheads 750, 850 of the present disclosure, and may, hence, include an embodiment of at least one of the fragmentation bodies 100, 200, 300, 400, 500, 600 described above. In additional embodiments, one or more components (e.g., rocket motor 972, fin assembly 976, warhead 982, etc.) of the ordnance 970 may be arranged in a different order or configuration depending on the intended use of the ordnance 970.

In operation, the ordnance 970 may guided to a location proximate the at least one target using the guidance/control system (not shown). Upon reaching a desired proximity to the at least one target, the warhead 982 may experience an explosive launch effectuated by the detonation of an explosive charge (e.g., the explosive charges 754, 854 described above) therein. The explosion of the explosive charge results in the fracturing, fragmentation, and comminution of at least one fragmentation body (e.g., one of fragmentation bodies 100, 200, 300, 400, 500, 600 described above) of the warhead 982 to form a plurality of discrete fragments (not shown). The plurality of discrete fragments are propelled and scattered outwardly from the ordnance 970, at least a portion of the plurality of discrete fragments being propelled and scattered toward the at least one target. Upon reaching the target, the at least a portion of the plurality of discrete fragments may damage or destroy the at least one target.

Applications of the various embodiments of the present disclosure may include use in at least one of fragmentary warheads, rockets and missiles incorporating such warheads, fragmentary medium caliber munitions, unmanned vehicles, structural components in such unmanned vehicles, projectiles and bullets, and other types of weapons and munitions. By way of non-limiting example, the fragmentation bodies 100, 200, 300, 400, 500, 600 of the present disclosure may at least be used in SWITCHBLADE™ warheads.

Embodiments of the present disclosure provide improved fragmentation control and warhead performance as compared to many conventional warheads. Explosive gas venting properties of the fragmentation bodies 100, 200, 300, 400, 500, 600, in that the fragmentation body configurations temporarily constrain release of gases generated upon initiation of an adjacent explosive charge to increase forces acting upon the fragments and orient the fragments toward their intended trajectories enable relatively enhanced fragment velocities and more accurate fragment trajectories upon explosive launch. In addition, the fragmentation bodies 100, 200, 300, 400, 500, 600 facilitate the consistent formation of discrete fragments of predetermined sizes and predetermined shapes. Further, fragmentation bodies 100, 200, 300, 400, 500, 600 are relatively easy to produce, to handle, and to place in a warhead assembly, and so facilitate improved warhead cost-efficiency and quality by removing variables introduced by manual fragment placement as well as greatly reducing labor time in warhead assembly.

The following examples serve to explain embodiments of the present disclosure in more detail. The examples are not to be construed as being exhaustive or exclusive as to the scope of the disclosure.

EXAMPLES

Example 1

Figure 10A:
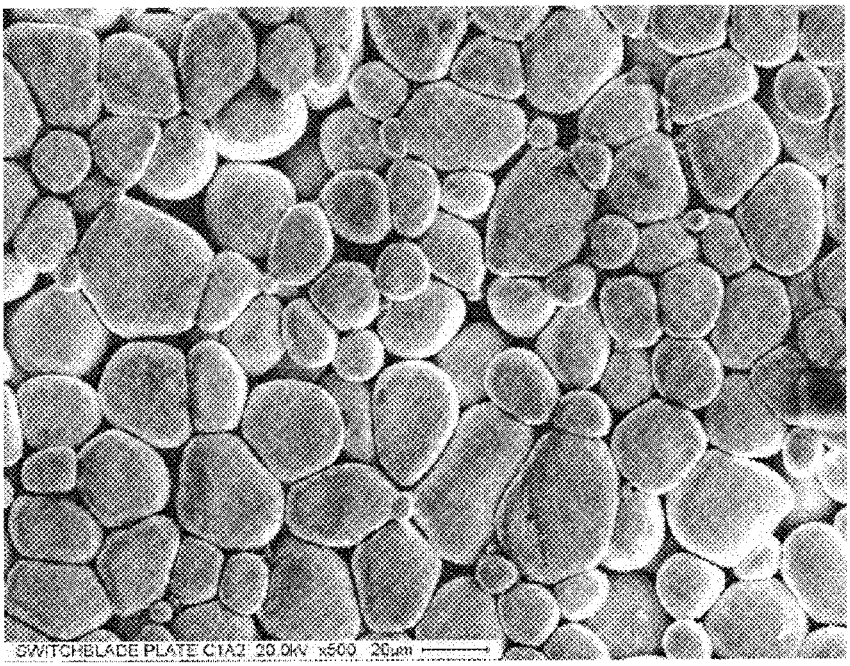
FIG. 10A is a scanning electron micrograph showing a top-down view of a tungsten-based alloy, as described in Example 1.
Figure 10B:
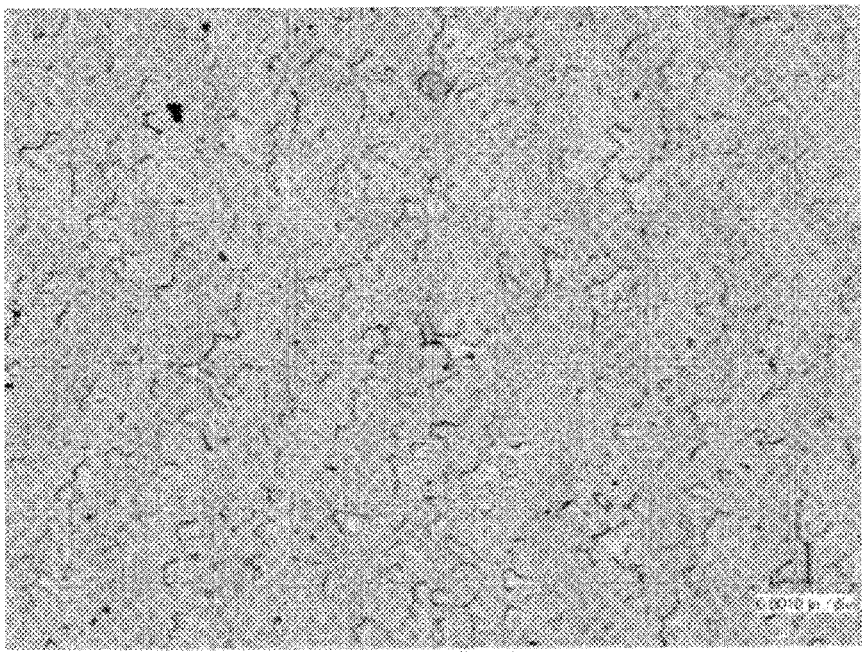
FIG. 10B is a scanning electron micrograph showing a polished cross-section of the tungsten-based alloy of FIG. 10A, as described in Example 1.
Figure 11A:
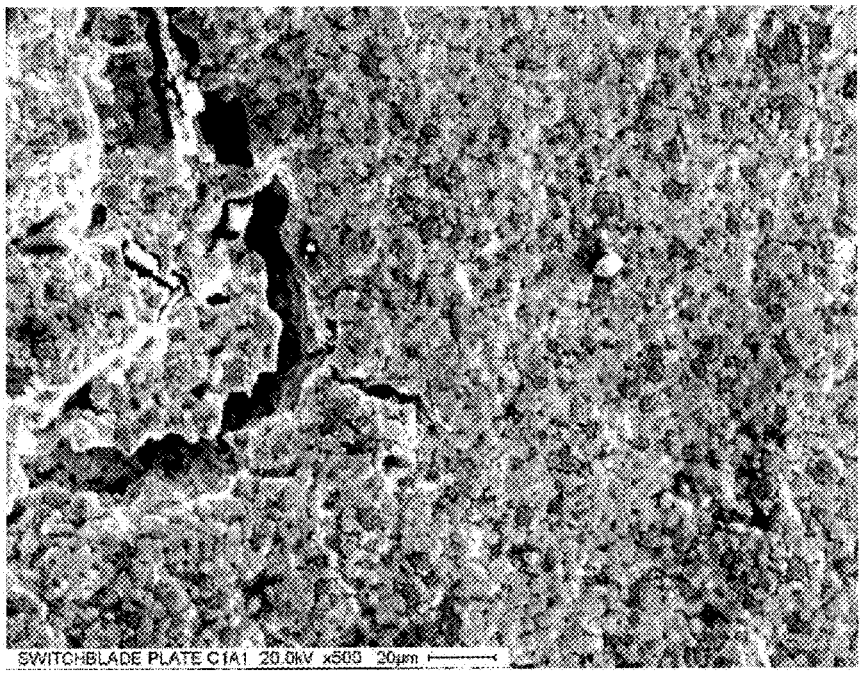
FIG. 11A is a scanning electron micrograph showing a top-down view of another tungsten-based alloy, as described in Example 1.
Figure 11B:
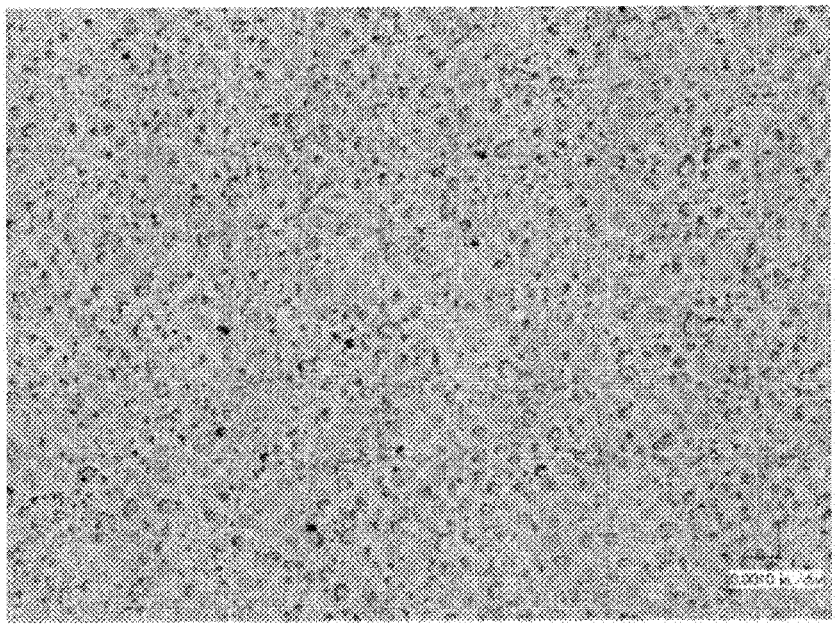
FIG. 11B is a scanning electron micrograph showing a polished cross-section of the another tungsten-based alloy of FIG. 11A, as described in Example 1.

A first tungsten-based alloy (A1) and a second tungsten-based alloy (A2) were prepared. A1 included 90 wt % tungsten, 7 wt % nickel, and 3 wt % iron. A2 included 90 wt % tungsten, 6 wt % nickel, and 4 wt % copper. Larger tungsten particles were used in the preparation of A1 than were used in the preparation of A2. A1 was designed to have relatively higher strength and relatively lower ductility, and A2 was designed to have relatively lower strength and relatively higher ductility. FIG. 10A is a scanning electron micrograph (SEM) showing a top-down view of A1. FIG. 10B is an SEM showing a view of a polished cross-section of A1. FIG. 11A is an SEM showing a top-down view of A2. FIG. 11B is an SEM showing a view of a polished cross-section of A2.

Example 2

A1 and A2 of Example 1 were used to form three different fragmentation body configurations (C1, C2, and C3) each. The geometric configurations of each of the different fragmentation body configurations (C1A1, C1A2, C2A1, C2A2, C3A1, C3A2) are summarized in Table 1 below. In Table 1, "M" refers to middle, "S" refers to side, "*" designates values that could not be determined due damage incurred (e.g., a break) during the manufacture of the fragmentation body, and "" indicates that the listed height value corresponds to the non-elevated portion (i.e., "remainder" portion, as described above in reference to FIG. 2**A) of the fragmentation body. The elevated portions of C3A1 and C3A2 each had heights of 0.107 inch.

TABLE 1

Dimensions of Multiple Fragmentation Body Configurations Using A1 and A2

| Inches | Length | Width | Height | Taper Frag Side | Taper Frag Middle | Square Frag Side | Square Frag Middle | Taper Frag Groove S | Taper Frag Groove M | Square Frag Groove S | Square Frag Groove M |
|---|---|---|---|---|---|---|---|---|---|---|---|
| C1A1 | 2.024 | 1.337 | 0.107 | .122 × .124 | .121 × .125 | .133 × .134 | .132 × .135 | 0.024 | 0.025 | 0.015 | 0.015 |
| C1A2 | 2.041 | 1.350 | 0.108 | .124 × .126 | .122 × .126 | .134 × .136 | .134 × .136 | 0.025 | 0.026 | 0.015 | 0.015 |
| C2A1 | * | * | 0.073 | .098 × .095 | .097 × .096 | 0.099 × .096 | .099 × .097 | 0.017 | 0.017 | 0.016 | 0.015 |
| C2A2 | 2.051 | 1.350 | 0.073 | .098 × .095 | .098 × .097 | .100 × .097 | .100 × .097 | 0.018 | 0.016 | 0.016 | 0.017 |
| C3A1 | * | 1.338 | **0.073 | .093 × .089 | .139 × .149 | .100 × .097 | .146 × .155 | 0.021 | 0.020 | 0.014 | 0.015 |
| C3A2 | 2.042 | 1.348 | **0.073 | .096 × .094 | .140 × .149 | .101 × .101 | .145 × .156 | 0.021 | 0.021 | 0.015 | 0.015 |

Figure 12A:
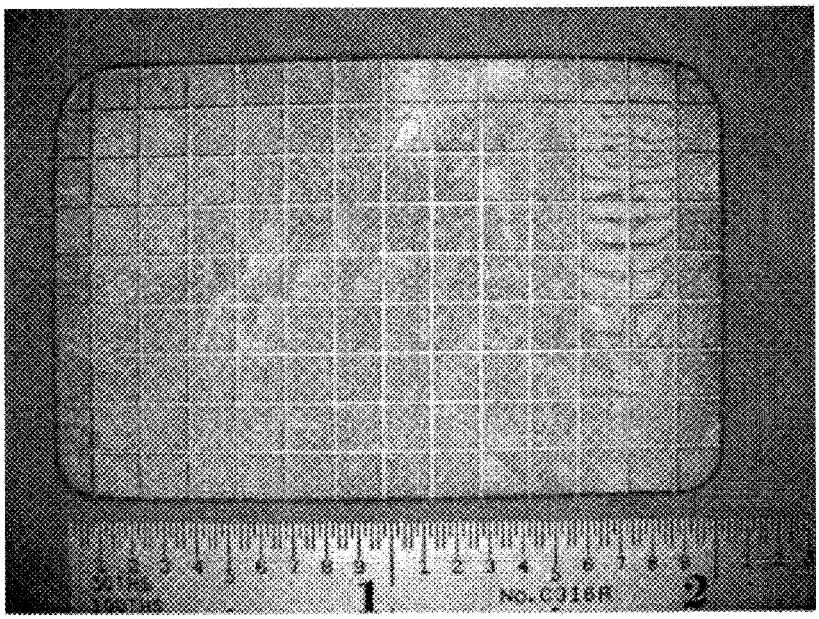
FIG. 12A is a photograph showing a top-down view of a fragmentation plate, as described in Example 2.
Figure 12B:
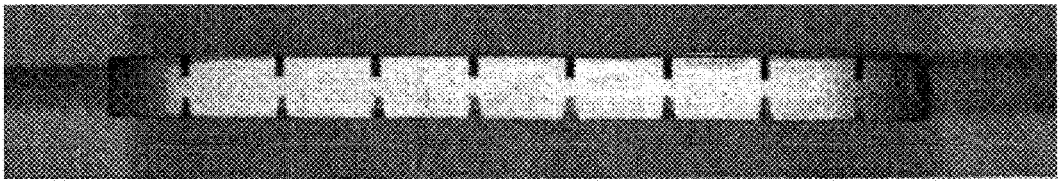
FIG. 12B is a photograph showing a side elevation view of the fragmentation plate of FIG. 12A, as described in Example 2.
Figure 13A:
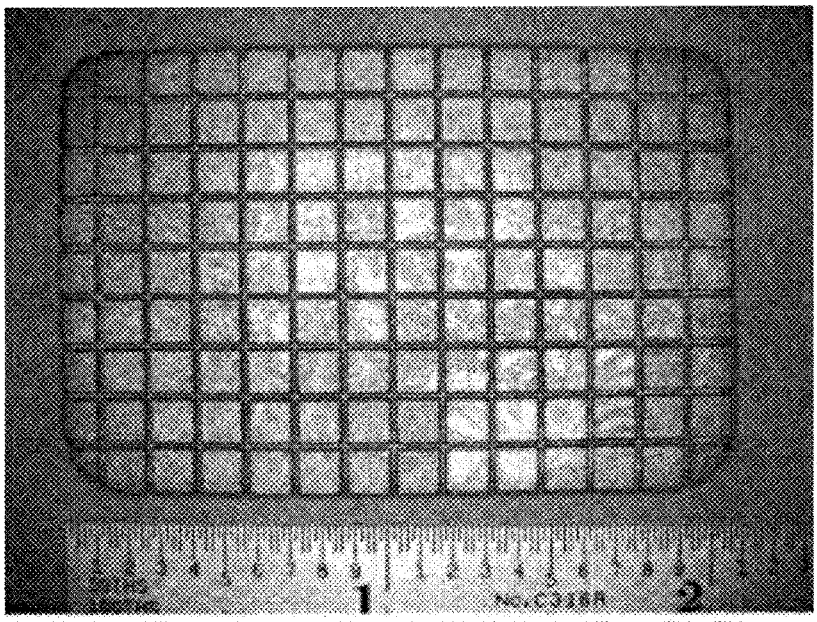
FIG. 13A is a photograph showing a top-down view of another fragmentation plate, as described in Example 2.
Figure 13B:
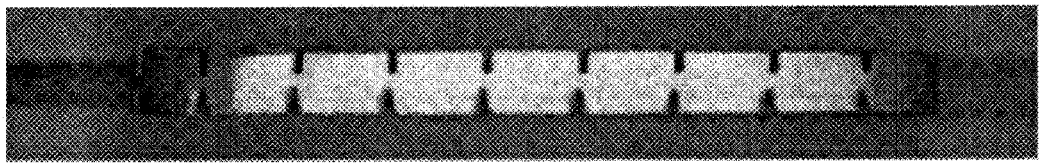
FIG. 13B is a photograph showing a side elevation view of the another fragmentation plate of FIG. 13A, as described in Example 2.
Figure 14A:
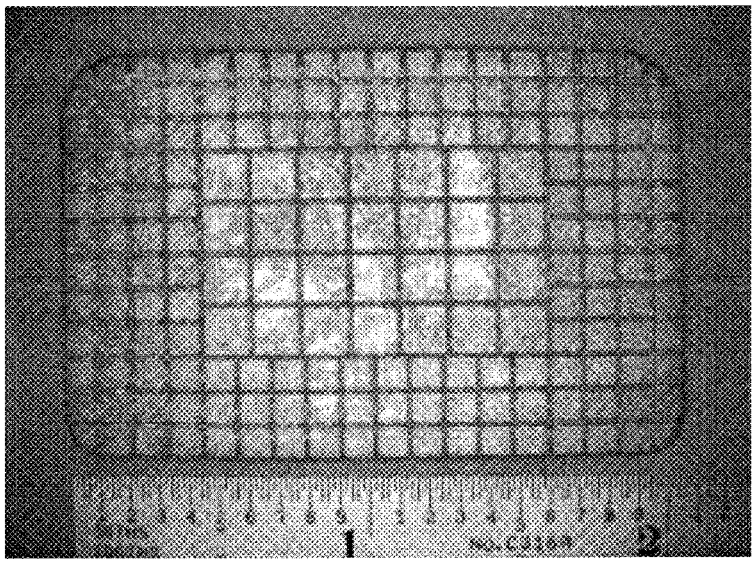
FIG. 14A is a photograph showing a top-down view of yet another fragmentation plate, as described in Example 2.
Figure 14B:
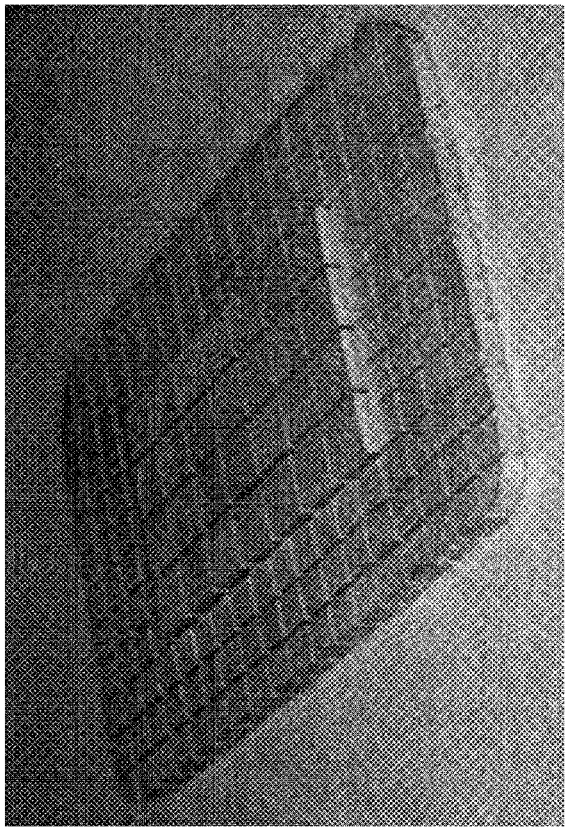
FIG. 14B is a photograph showing a perspective view of the yet another fragmentation plate of FIG. 14A, as described in Example 2.
Figure 14C:
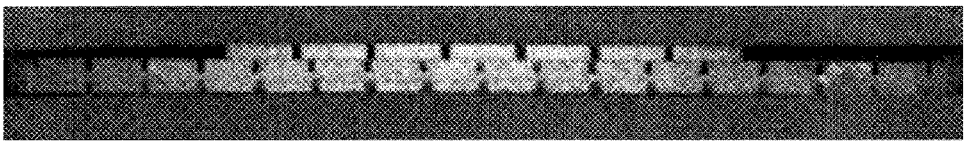
FIG. 14C is a photograph showing a side elevation view of the yet another fragmentation plate of FIG. 14A, as described in Example 2.
Figure 15:
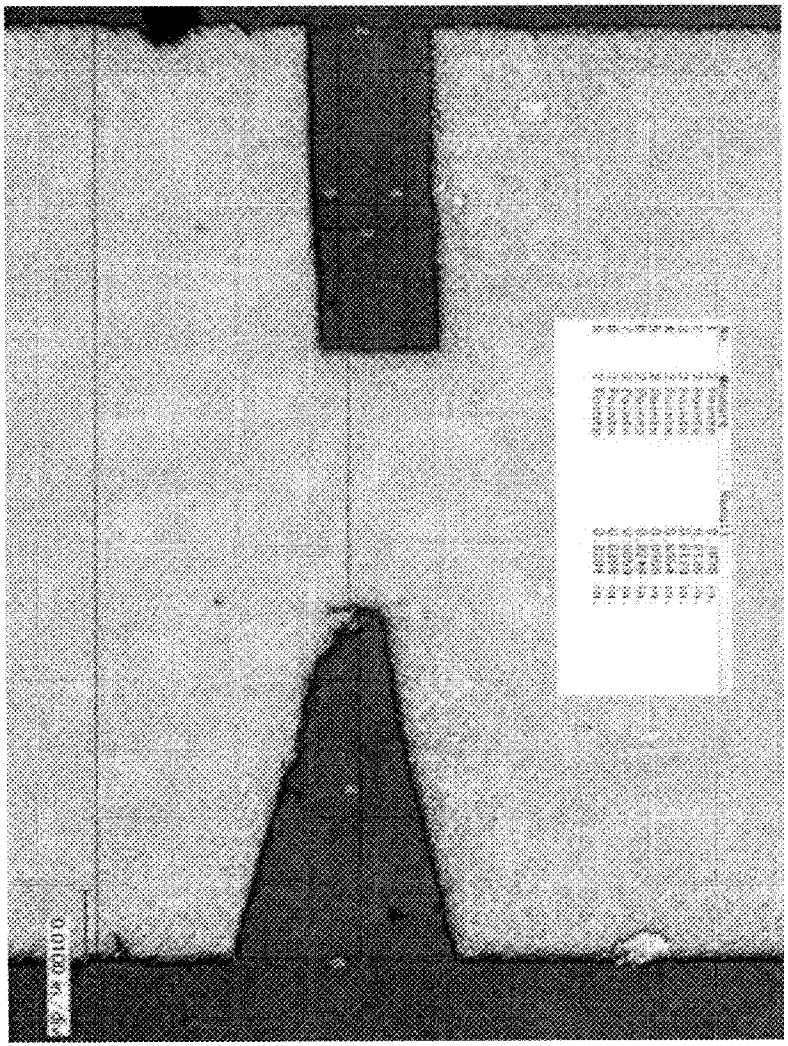
FIG. 15 is a scanning electron micrograph showing a cross-sectional view of the indentation geometry of the fragmentation plate of FIG. 12A, as described in Example 2.

C1A1 and C1A2 each had 126 interconnected fragments, arranged as a matrix of 14 columns and 9 rows. 122 the interconnected fragments each had a mass of approximately 8 grains, and 4 of the interconnected fragments (i.e., the interconnected fragments located at the peripheral corners of each fragmentation body) each had a mass of approximately 2 grains. C2A1 and C2A2 each had 216 interconnected fragments, arranged as a matrix of 18 columns and 12 rows. 212 of the interconnected fragments each had a mass of approximate 3 grains, and 4 of the interconnected fragments (i.e., the interconnected fragments located at the peripheral corners of each fragmentation body) each had a mass of approximately 1 grain. C3A1 and C3A2 each had 174 interconnected fragments, with 28 of the interconnected fragments each having a mass of approximately 8 grains, 152 of the interconnected fragments each having a mass of approximately 3 grains, and 4 of the interconnected fragments (i.e., the interconnected fragments located at the peripheral corners of each fragmentation body) each having a mass of approximately 1 grain. FIGS. 12A and 12B are photographs showing a top-down view of C1A1 and a side elevation view of C1A1, respectively. C1A2 had a substantially similar structure. FIGS. 13A and 13B are photographs showing a top-down view of C2A2 and a side elevation view of C2A2, respectively. C2A1 had a substantially similar structure irrespective of the damage that occurred during the manufacture thereof. FIGS. 14A, 14B, and 14C are photographs showing a top-down view of C3A2, a perspective view of C3A2, and a side elevation view of C3A2, respectively. C3A1 had a substantially similar structure irrespective of the damage that occurred during the manufacture thereof. FIG. 15 is an SEM showing the indentation geometry of between two interconnected fragments of C1A1. C1A2, C2A1, C2A2, and the non-elevated portions of C3A1 and C3A2 (i.e., the "remainder" portions, as described above in reference to FIG. 2A) had substantially similar indentation geometries.

Example 3

The microhardness values of C1A2 and C1A2 of Example 2 were tested. The results of the testing are summarized in Table 2 and Table 3 below. With reference to FIG. 12A, in each of Table 2 and Table 3, "#1," "#3," "#5," and "#7," refer to the second, fourth, sixth, and eighth rows of interconnected fragments, beginning from the top of the fragmentation body (i.e., the side of the fragmentation body opposite the side of the fragmentation body that is adjacent the ruler in the photograph).

TABLE 2

C1A1 Microhardness Values

| C1A1 | Indent 1 | Indent 2 | Average | Vickers | HRC |
|---|---|---|---|---|---|
| #1 | 54.4 | 53.8 | 54.1 | 317 | 31 |
| #3 | 52.0 | 52.1 | 52.1 | 343 | 35 |
| #5 | 51.8 | 51.8 | 51.8 | 346 | 35 |
| #7 | 51.8 | 52.7 | 52.3 | 339 | 34.5 |
| | | | | | 33.9 |

TABLE 3

C1A2 Microhardness Values

| C1A2 | Indent 1 | Indent 2 | Average | Vickers | HRC |
|---|---|---|---|---|---|
| #1 | 53.2 | 53.4 | 53.3 | 326 | 33 |
| #3 | 54.3 | 54 | 54.2 | 318 | 32 |
| #5 | 55 | 55.2 | 55.1 | 305 | 30.5 |
| #7 | 54.3 | 52.8 | 53.6 | 323 | 32.5 |
| | | | | | 32.0 |

Example 4

Sample warheads were prepared and tested to determine fragment break-up, fragment dispersion, and fragment velocity. Each sample warhead included a containment, at least 88 grams of Comp C-4 explosive material, and an inner barrier material of aluminum. For each of the sample warheads, the inner barrier material was adhered into the containment using HARDMAN® Double Bubble epoxy. The Comp C-4 explosive material was hand-packed into the containment. One of the sample warheads had a baseline configuration including 122 discrete A1 fragments, arranged as a matrix of 14 columns and 9 rows, each of the discrete A1 fragments having a mass of approximately 8 grains. The 122 discrete A1 fragments were individually adhered to the inner barrier material of aluminum using HARDMAN® Double Bubble epoxy. The remainder of the sample warheads included at least one of the fragmentation body configurations of Example 2 above. A fragmentation body was adhered to the inner barrier material with HARDMAN® Double Bubble epoxy. Triangular indentations on the fragmentation body faced the inner barrier material. Several of the sample warheads included an additional fragmentation body adhered to the fragmentation body with HARDMAN® Double Bubble epoxy. The configurations of each of the sample warheads is summarized in Table 4 below. In Table 4, "*" designates that the sample warhead included approximately 34 grams of additional Comp C-4 explosive material.

TABLE 4

| Sample Warhead Configurations | | | |
|---|---|---|---|
| Test # | Test Configuration | Explosive Mass [gm] | Total Mass [gm] |
| 1 | C1A2 | 88.26 | 186.1 |
| 2 | C1A1 | 89.49 | 188.15 |
| 3 | Baseline | 88.59 | 185.2 |
| 4 | C2A1 | 89.51 | 164.27 |
| 5 | C3A1 | 88.11 | 169.34 |
| 6 | C2A2 Double Stack | 90.3 | 211.13 |
| 7 | C1A2 Double Stack | 91.4 | 259.19 |
| 8 | C3A2&C2A2 (C2A2 closest to the explosive) | 89.66 | 216.97 |
| 9 | C1A2 Triple Stack* | 125.33 | 357.14 |

Each of the sample warheads listed in Table 4 was tested. A 4 foot by 4 foot witness panel including 20-gauge steel was provided approximately 31 inches from a front of each of the sample warheads. The corresponding included angle was 75 degrees. A 0.5 inch diameter hole was drilled in the center of the witness panel such that flash from an initiation of the each of the sample warheads would be visible during high-speed photography and indicate time zero for velocity calculations. The equipment used to record and analyze an explosive launch of each of the sample warheads included a high-speed video camera that was capable of recording at 26,000 frames per second with a 10 microsecond exposure. Table 5 below summarizes the fragment velocity results for each of the sample warheads listed in Table 4. In Table 5, "*" designates that the sample warhead included approximately 34 grams of additional Comp C-4 explosive material. FIGS. 16A through 16I are photographs showing the backlit witness panel following the explosive launch of each of the sample warheads listed in Table 4, respectively (e.g., FIG. 16A corresponds to the sample warhead including the C1A2 configuration, FIG. 16B corresponds to the sample warhead including the C1A2 configuration, FIG. 16C corresponds to the sample warhead including the baseline configuration, FIG. 16D corresponds to the sample warhead including the C2A1 configuration, etc.).

TABLE 5

| Sample Warhead Velocity Results | | | |
|---|---|---|---|
| Test # | Test Configuration | Maximum Velocity (ft/s) | Minimum Velocity (ft/s) |
| 1 | C1A2 | 3229 | 1861 |
| 2 | C1A1 | 3229 | 1993 |
| 3 | Baseline | 3100 | 2055 |
| 4 | C2A1 | 4079 | 2628 |
| 5 | C3A1 | 3780 | 2354 |
| 6 | C2A2 Double Stack | 2672 | 1704 |
| 7 | C1A2 Double Stack | 1685 | 1110 |
| 8 | C3A2&C2A2 (C2A2 closest to the explosive) | 2385 | 1529 |
| 9 | C1A2 Triple Stack* | 1845 | 900 |

Figure 16A:
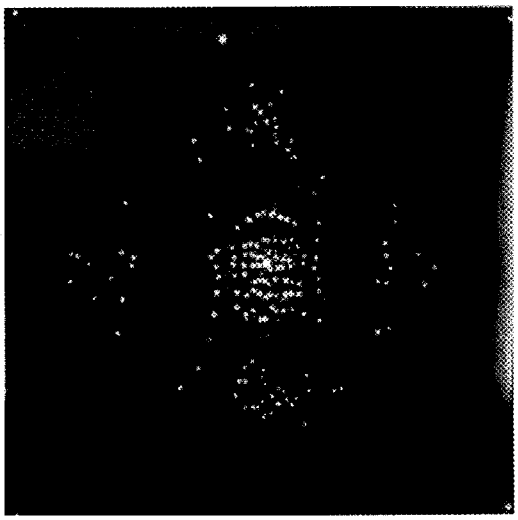
FIGS. 16A-16I are each photographs showing a backlit witness panel following an explosive launch of a sample warhead, as described in Example 3.
Figure 16B:
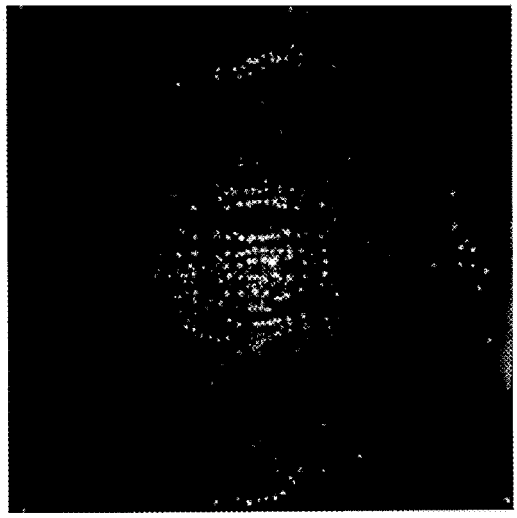
Figure 16C:
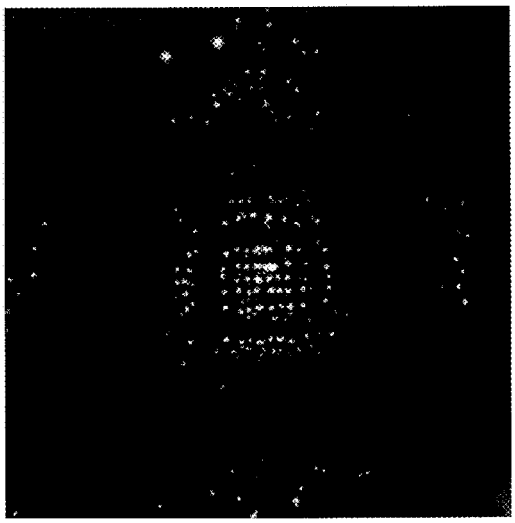

Referring to FIGS. 16A through 16C, the baseline configuration (FIG. 16C) exhibited an included angle of approximately 65 degrees, and each of the C1A2 configuration and the C1A1 configuration exhibited an included angle of 75 degrees. Without being bound to a particular theory, the relatively increased included angle for each of the C1A2 configuration and the C1A1 configuration as compared to the baseline configuration is believe to be attributed to the outer rows and columns of the interconnected fragments being farther away from the sample warhead centerlines. The relatively increased distance from centerline results from the distance between the interconnected fragments (i.e., the indentation widths). Interconnected fragments located at farther distances from the warhead centerline are believed to be subjected to higher pressure gradients from shockwave curvature, causing larger gaps between the outer rows and outer columns of the interconnect fragments and facilitating greater venting of explosive gases. The venting gases are believed to impart a high radial force enabling interconnected fragments to be ejected at steeper angle upon being fractured along the indentations. In addition, the overall included angle for fragments originating from a center position in the each of the C1A2 configuration and the C1A1 configuration was also greater than that of fragments originating from a center position of the baseline configuration. As shown in FIGS. 16A through 16C, baseline configuration center fragments exhibit an included angle of approximately 15 degrees, as compared to included angle of approximately 22 degrees and 20 degrees for the C1A1 configuration and the C1A2 configuration, respectively. The relatively increased included angle of the C1A1 configuration and the C1A2 configuration is believed to be attributed to the increased distance of the interconnected fragments from the warhead centerline, as described above. Furthermore, as shown in Table 5, each of the C1A1 configuration and the C1A2 configuration exhibited increased maximum velocity as compared to the baseline configuration. Without being bound to a particular theory, it is believed that the relatively increased maximum velocity was due to a delay in the venting of explosive gases because of the interconnected portions of the interconnected fragments. The delay in venting is believed to subject the interconnected fragments to pressure from the explosive gases for a longer period and facilitate increased transfer of energy. Substantially all of the interconnected fragments of each of the C1A2 configuration and the C1A1 configuration appeared to break-up.

Figure 16D:
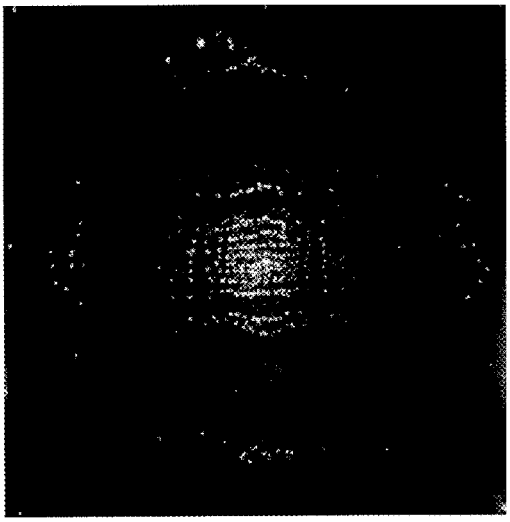

Referring to FIG. 16D, the C2A1 configuration exhibited an included angle of approximately 70 degrees for outer rows and columns of the interconnected fragments, and an included angle of approximately 25 degrees for a remainder of the interconnected fragments. In addition, as shown in Table 5, the maximum velocity for the C2A1 configuration was 4079 feet per second, the highest velocity of all the sample warhead configurations tested. Micro-fragment perforations were also seen in the high-speed video with velocities between about 6200 feet per second and about 5962 feet per second. The relatively high velocities are believed to be attributed to the small fragment mass (e.g., approximately 3 grains) and a high charge-to-mass ratio. Substantially all of the interconnected fragments of the C2A1 configuration appeared to break-up.

Figure 16E:
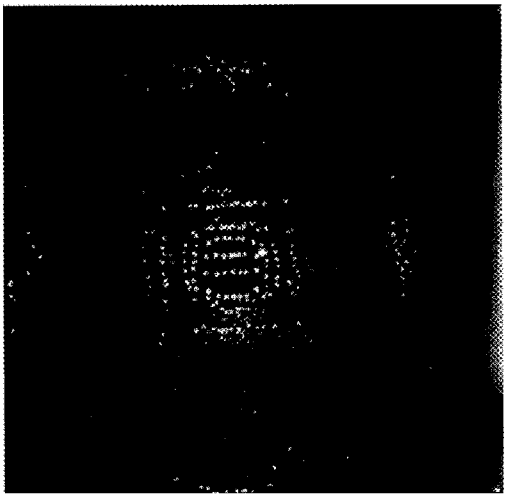

Referring to FIG. 16E, the C3A1 configuration exhibited an included angle of approximately 65 degrees for outer rows and columns of the interconnected fragments, and an included angle of approximately 25 degrees for a remainder of the interconnected fragments. In addition, as shown in Table 5, the maximum velocity for the C3A1 configuration was about 3780 feet per second. The high-speed video showed that 3-grain fragments from the outer portions of the fragmentation body struck the witness panel before 8-grain fragments originating from the central portions of the fragmentation body. The 8-grain fragments were determined to have a velocity of approximately 3039 feet per second. Without being bound to a particular theory, the relatively lower velocity of the 8-grain fragments formed from the break-up of the C3A1 configuration as compared to the velocity of the 8-grain fragments formed from the break-up of each of the C1A1 configuration and the C1A2 configuration is believed to be attributed to a relative increase in explosive gas venting where the 3-grain interconnected fragments interconnected with the 8-grain interconnected fragments. Substantially all of the interconnected fragments of the C3A1 configuration appeared to break-up.

Figure 16F:
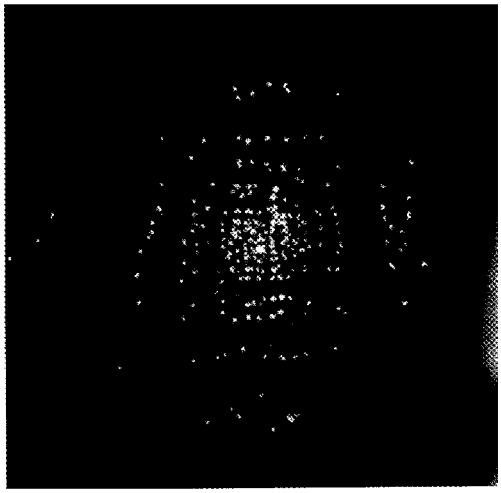

Referring to FIG. 16F, the C2A2 double stack configuration (i.e., a fragmentation body having a C2A2 configuration on another fragmentation body having a C2A2 configuration) exhibited an included angle of approximately 60 degrees for outer rows and columns of the interconnected fragments, and an included angle of approximately 30 degrees for a remainder of the interconnected fragments. The C2A2 double stack configuration facilitated an increased breadth of fragment penetrations as compared to each of the single fragmentation body configurations depicted in FIGS. 16A through 16E. Without being bound to a particular theory, it is believed that the outer rows and columns of interconnected fragments of the upper fragmentation body (i.e., the fragmentation body farthest from the explosive) are not subjected to same high radial pressure forces as the lower fragmentation body (i.e., the fragmentation body closest to the explosive). Gases venting through fractured outer rows and columns of the interconnected fragments of the lower fragmentation body break-up or fracture the outer rows and columns of the interconnected fragments of the upper fragmentation body. As the upper fragmentation body breaks-up, the venting gases are believed to impart a relatively greater axial force (and a relatively lower radial force) on the outer rows and columns of the interconnected fragments thereof as compared to the axial force imparted on the outer rows and columns of the interconnected fragments of the lower fragmentation body. In addition, as shown in Table 5, the maximum velocity for the C2A2 double stack configuration was about 2672 feet per second. A portion of the interconnected fragments of the C2A2 double stack configuration did not appear to substantially break-up.

Figure 16G:
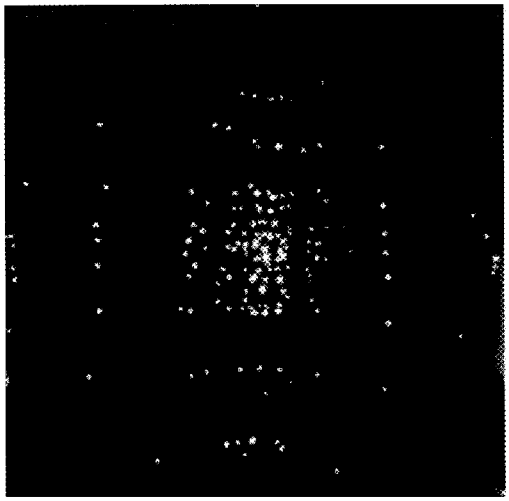

Referring to FIG. 16G, the C1A2 double stack configuration (i.e., a fragmentation body having a C1A2 configuration on another fragmentation body having a C1A2 configuration) exhibited an included angle of approximately 75 degrees along a horizontal axis and an included angle of approximately 65 degrees along a vertical axis. Similar to the C2A2 double stack configuration, the C1A2 double stack configuration exhibited an increased breadth of fragment penetrations as compared to the fragment penetrations of each of the single fragmentation body configurations depicted in FIGS. 16A through 16E. In addition, as shown in Table 5, the maximum velocity for the C1A2 double stack configuration was 1685 feet per second. The relatively lower maximum velocity is believed to be due to a low charge-to-mass ratio. A portion of the interconnected fragments of the C1A2 double stack configuration did not appear to substantially break-up.

Figure 16H:
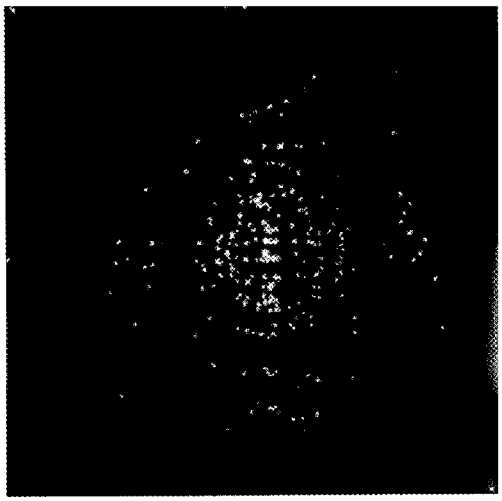

Referring to FIG. 16H, the C3A2 and C2A2 stack configuration (i.e., a fragmentation body having a C3A2 configuration on another fragmentation body having a C2A2 configuration) exhibited an included angle of approximately 65 degrees. In addition, as shown in Table 5, the maximum velocity for the C3A2 and C2A2 stack configuration was about 2385 feet per second. The high-speed video showed that 3-grain fragments struck the witness panel before 8-grain fragments. A portion of the interconnected fragments of the C3A2 and C2A2 stack configuration did not appear to substantially break-up.

Figure 16I:
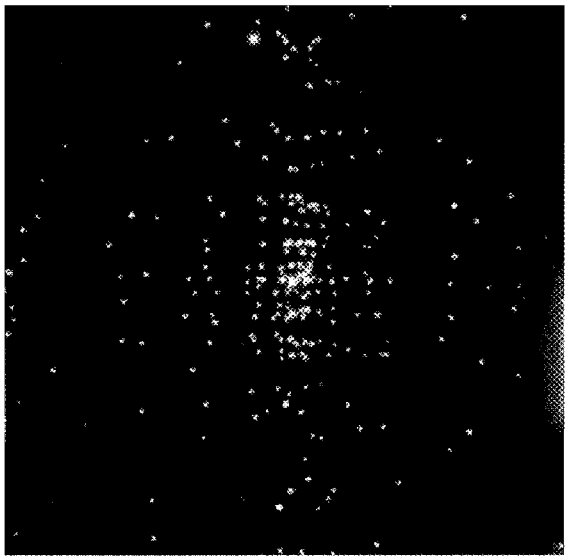

Referring to FIG. 16I, the C1A2 triple stack configuration (i.e., a fragmentation body having a C1A2 configuration on another fragmentation body having a C1A2 configuration, the another fragmentation body on yet another fragmentation body having a C1A2 configuration) exhibited an included angle of at least 75 degrees (i.e., the extent of the witness panel). The C1A2 triple stack configuration exhibited the largest breadth of fragment penetrations of the fragmentation body configurations tested. In addition, as shown in Table 5, the maximum velocity for the C1A2 triple stack configuration was about 1845 feet per second. A portion of the interconnected fragments of the C1A2 triple stack configuration did not appear to substantially break-up.

Figure 17A:
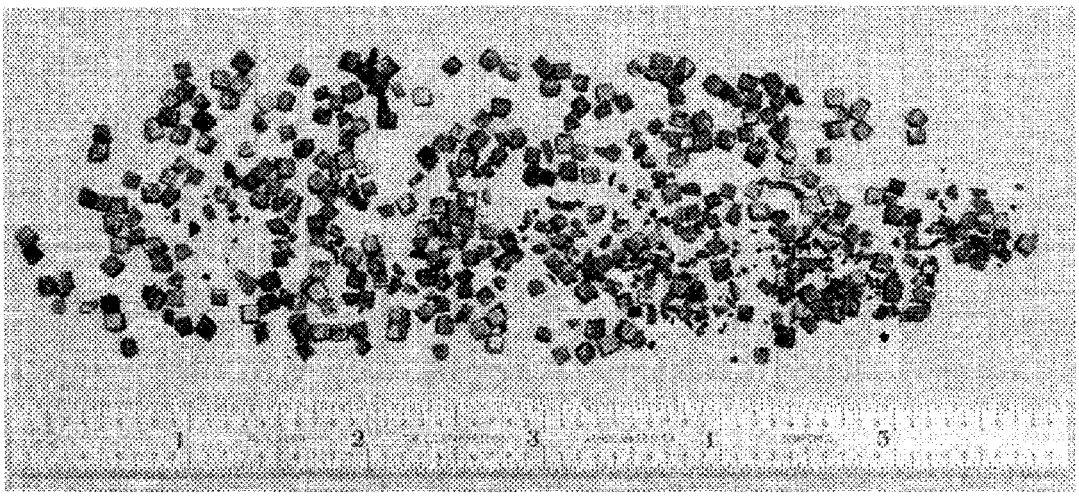
FIG. 17A is a photograph showing discrete fragments formed upon an explosive launch of a sample warhead, as described in Example 3.
Figure 17B:
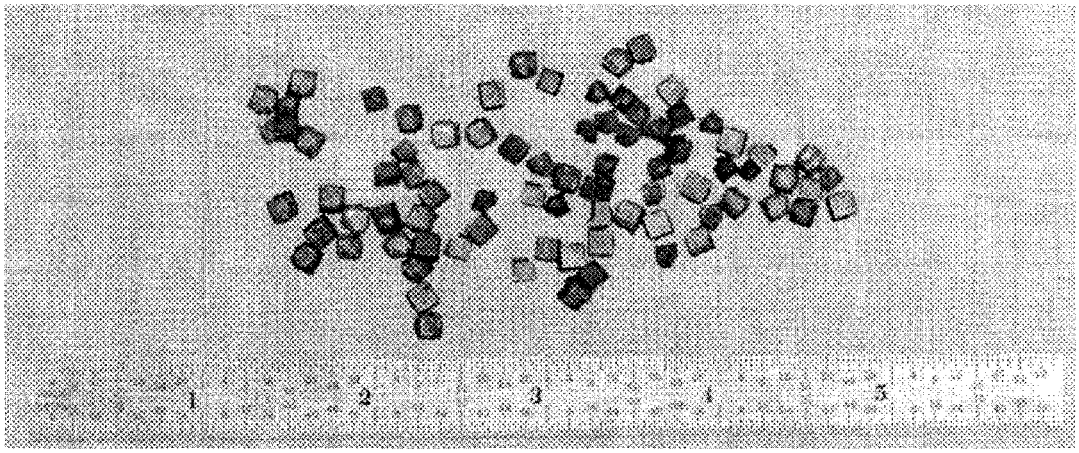
FIG. 17B is a photograph showing discrete fragments faulted upon an explosive launch of another sample warhead, as described in Example 3.

FIG. 17A is a photograph showing discrete fragments that were formed upon the break-up (by an explosive launch of the sample warhead) of the interconnected fragments of the C2A1 configuration. Each of the discrete fragments had a mass of up to approximately 3 grains. FIG. 17B shows discrete fragments that were formed upon the break-up (by explosive launch of the sample warhead) of the interconnected fragments of the C1A1 configuration. Each of the discrete fragments had a mass of approximately 8 grains.

While the present disclosure is susceptible to various modifications and alternative forms, specific embodiments have been shown by way of example in the drawings and have been described in detail herein. However, the present disclosure is not intended to be limited to the particular forms disclosed. Rather, the present disclosure is to cover all modifications, equivalents, and alternatives falling within the scope of the present invention as defined by the following appended claims and their legal equivalents.

What is claimed is:

1. A fragmentation body, comprising:

a substantially monolithic structure comprising a metal material comprising at least one high-density metal and at least one metal having a lower melting point than the at least one high-density metal, the substantially monolithic structure exhibiting:

a major surface having an indentation pattern therein; and an opposing major surface having an opposing indentation pattern therein, the opposing indentation pattern substantially aligned with the indentation pattern.

2. The fragmentation body of claim 1, wherein the at least one high-density metal comprises tungsten.

3. The fragmentation body of claim 1, wherein the metal material is substantially inert.

4. The fragmentation body of claim 1, wherein the metal material is substantially reactive.

5. The fragmentation body of claim 1, wherein a ratio between a distance between each adjacent parallel indentation of the indentation pattern and a height of the substantially monolithic structure is within a range of from about 1.5:1 to about 2.5:1.

6. The fragmentation body of claim 1, wherein at least one indentation of the indentation pattern has a substantially different shape than at least one substantially aligned indentation of the opposing indentation pattern.

7. The fragmentation body of claim 1, wherein the indentation pattern comprises:

a first array of indentations extending across at least a portion of the major surface in a first direction; and a second array of indentations extending across the at least a portion of the major surface in a second direction such that the first array of indentations and the second array of indentations at least partially intersect.

8. The fragmentation body of claim 7, wherein each indentation of at least one of the first array of indentations and the second array of indentations is substantially uniformly spaced.

9. The fragmentation body of claim 7, wherein the opposing indentation pattern comprises:

a first opposing array of indentations substantially aligned with the first array of indentations and extending across at least a portion of the opposing major surface in the first direction; and a second opposing array of indentations substantially aligned with the second array of indentations and extending across the at least a portion of the opposing major surface in the second direction such that the first opposing array of indentations and the second opposing array of indentations at least partially intersect.

10. The fragmentation body of claim 9, wherein the indentation pattern further comprises at least one additional indentation, and wherein the opposing indentation pattern further comprises at least one additional opposing indentation substantially aligned with the at least one additional indentation.

11. The fragmentation body of claim 9, wherein at least one of the major surface and the opposing major surface has at least one elevated portion.

12. The fragmentation body of claim 11, wherein each of a third array of indentations and a fourth array of indentations extends across the elevated portion of the at least one of the major surface and the opposing major surface, and wherein each of the first array of indentations and the second array of indentations extends across a remaining portion of the at least one of the major surface and the opposing major surface.

13. The fragmentation body of claim 12, wherein parallel indentations extending across the elevated portion are set apart by a substantially uniform distance, and wherein other parallel indentations extending across the remaining portion are set apart by a different substantially uniform distance.

14. The fragmentation body of claim 1, wherein the indentation pattern and the opposing indentation pattern at least partially define interconnected fragments, each of the interconnected fragments comprising:

a first region at least partially defined by the indentation pattern;

a second region at least partially defined by the opposing indentation pattern; and an intermediary region between the first region and the second region, the intermediary region extending across the substantially monolithic structure between each of the interconnected fragments.

15. The fragmentation body of claim 14, wherein at least one of the interconnected fragments has a substantially different size than at least one other of the interconnected fragments.

16. The fragmentation body of claim 14, wherein each of the interconnected fragments has a mass within a range of from about 1 grain to about 30 grains.

17. The fragmentation body of claim 1, wherein at least a portion of the substantially monolithic structure is substantially planar.

18. The fragmentation body of claim 1, wherein at least a portion of the substantially monolithic structure is substantially curved.

19. A warhead, comprising:

an explosive charge; and at least one fragmentation body adjacent the explosive charge and comprising:

a substantially monolithic structure comprising a metal material comprising at least one high-density metal and at least one metal having a lower melting point than the at least one high-density metal, the substantially monolithic structure exhibiting:

a major surface having an indentation pattern formed therein; and an opposing major surface having an opposing indentation pattern formed therein, the opposing indentation pattern substantially aligned with the indentation pattern.

20. The warhead of claim 19, wherein the at least one fragmentation body is configured to break up along the substantially aligned indentation pattern and the substantially aligned opposing indentation pattern into a plurality of discrete fragments of a substantially controlled shape and of a substantially controlled size upon detonation of the explosive charge.

21. The warhead of claim 19, further comprising a barrier material between the explosive charge and the at least one fragmentation body.

22. The warhead of claim 19, wherein the at least one fragmentation body comprises:

a first fragmentation body adjacent the explosive charge; and a second fragmentation body on the first fragmentation body.

23. The warhead of claim 22, wherein the first fragmentation body has a different geometric configuration than the second fragmentation body.

24. The warhead of claim 22, wherein the first fragmentation body and the second fragmentation body each comprise a substantially similar metal material.

25. The warhead of claim 22, wherein the first fragmentation body comprises a different metal material than the second fragmentation body.

26. An article of ordnance, comprising:

a rocket motor; and a warhead comprising:

an explosive charge;

at least one fragmentation body adjacent the explosive charge and comprising:

at least one fragmentation body comprising:

a substantially monolithic structure comprising a metal material comprising at least one high-density metal and at least one metal having a lower melting point than the at least one high-density metal, the substantially monolithic structure exhibiting:

a major surface having an indentation pattern formed therein; and an opposing major surface having an opposing indentation pattern formed therein, the opposing indentation pattern substantially aligned with the indentation pattern.

27. A fragmentation body, comprising:

a substantially monolithic structure comprising a metal material, and comprising:

a major surface having an indentation pattern therein; and an opposing major surface having an opposing indentation pattern therein, the opposing indentation pattern substantially aligned with the indentation pattern, at least one indentation of the indentation pattern having a substantially different shape than at least one substantially aligned indentation of the opposing indentation pattern.

28. The fragmentation body of claim 27, wherein the at least one indentation of the indentation pattern exhibits a substantially rectangular shape, and the at least one substantially aligned indentation of the opposing indentation pattern exhibits a substantially triangular shape.

29. A fragmentation body, comprising:

a substantially monolithic structure comprising a metal material, and comprising:

a major surface having an indentation pattern therein, the indentation pattern comprising:

a first array of indentations extending across at least a portion of the major surface in a first direction; and a second array of indentations extending across the at least a portion of the major surface in a second direction such that the first array of indentations and the second array of indentations at least partially intersect; and an opposing major surface having an opposing indentation pattern therein, the opposing indentation pattern substantially aligned with the indentation pattern and comprising:

a first opposing array of indentations substantially aligned with the first array of indentations and extending across at least a portion of the opposing major surface in the first direction; and a second opposing array of indentations substantially aligned with the second array of indentations and extending across the at least a portion of the opposing major surface in the second direction such that the first opposing array of indentations and the second opposing array of indentations at least partially intersect, at least one of the major surface and the opposing major surface having at least one elevated portion.

30. A warhead, comprising:

an explosive charge; and at least one fragmentation body adjacent the explosive charge and comprising:

a substantially monolithic structure comprising a metal material, and comprising:

a major surface having an indentation pattern therein; and an opposing major surface having an opposing indentation pattern therein, the opposing indentation pattern substantially aligned with the indentation pattern, at least one indentation of the indentation pattern having a substantially different shape than at least one substantially aligned indentation of the opposing indentation pattern.

* * * * *

UNITED STATES PATENT AND TRADEMARK OFFICE

CERTIFICATE OF CORRECTION

PATENT NO. : 8,973,503 B2
APPLICATION NO. : 13/550705
DATED : March 10, 2015
INVENTOR(S) : James D. Dunaway and John E. Bott It is certified that error appears in the above-identified patent and that said Letters Patent is hereby corrected as shown below:

On the title page:
In ITEM (73) Assignee:

change "Techsystem" to --Techsystems--

Signed and Sealed this
Sixteenth Day of February, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,973,503 B2
APPLICATION NO. : 13/550705
DATED : March 10, 2015
INVENTOR(S) : James D. Dunaway et al.

It is certified that error appears in the above-identified patent and that said Letters Patent is hereby corrected as shown below:

TITLE PAGE:

"In ITEM (73) Assignee: change "Techsystem" to --Techsystems--"

(as corrected to read in the Certificate of Correction issued February 16, 2016) is deleted and patent is returned to its original state with the applicant & assignee name in patent to read

--Alliant Techsystem Inc., Arlington, VA (US)--

Signed and Sealed this
Seventh Day of June, 2016

Michelle K. Lee

Michelle K. Lee
*Director of the United States Patent and Trademark Office*